United States Patent [19]

Koyama et al.

[11] Patent Number: 4,607,942

[45] Date of Patent: Aug. 26, 1986

[54] ELECTROSTATIC COPYING APPARATUS

[75] Inventors: Haruo Koyama, Yawata; Toshio Nishino, Sakai, both of Japan

[73] Assignee: Mita Industrial Co., Ltd., Japan

[21] Appl. No.: 650,605

[22] Filed: Sep. 14, 1984

[30] Foreign Application Priority Data

| | | | |
|---|---|---|---|
| Sep. 19, 1983 | [JP] | Japan | 58-171384 |
| Sep. 19, 1983 | [JP] | Japan | 58-171385 |
| Oct. 24, 1983 | [JP] | Japan | 58-198472 |
| Nov. 26, 1983 | [JP] | Japan | 58-221414 |
| Nov. 26, 1983 | [JP] | Japan | 58-221416 |
| Jan. 31, 1984 | [JP] | Japan | 59-14418 |
| Jan. 31, 1984 | [JP] | Japan | 59-14419 |
| Feb. 29, 1984 | [JP] | Japan | 59-36293 |

[51] Int. Cl.[4] ..... G03G 15/00; B65H 5/22

[52] U.S. Cl. ..... 355/3 SH; 355/14 SH; 271/3.1; 271/902

[58] Field of Search ..... 355/3 SH, 14 SH, 23–26; 271/3, 3.1, 4, 9, 65, 186, 902

[56] References Cited

U.S. PATENT DOCUMENTS

| | | | |
|---|---|---|---|
| 4,066,252 | 1/1978 | Wick | 271/65 X |
| 4,098,551 | 7/1978 | Komori et al. . | |
| 4,218,128 | 8/1980 | Satomi et al. | 271/4 X |
| 4,330,197 | 5/1982 | Smith et al. . | |
| 4,453,819 | 6/1984 | Wada et al. | 271/186 X |
| 4,561,772 | 12/1985 | Smith | 355/3 SH |

*Primary Examiner*—Arthur T. Grimley
*Assistant Examiner*—C. Romano
*Attorney, Agent, or Firm*—Beveridge, De Grandi & Weilacher

[57] ABSTRACT

An electrostatic copying apparatus having defined therein a copying paper conveying passage extending from a paper feeder to a paper receiver through a transfer zone and a fixing zone. In the transfer zone, a toner image on an electrostatographic material is transferred to a copying paper, and then fixed in the fixing zone. The electrostatic copying apparatus includes a paper swerving device disposed within the paper conveying passage and between the fixing zone and the paper receiver and adapted to be selectively held at a non-operating position at which it permits the copying paper to be discharged into the paper receiver through the paper conveying passage and an operating position at which it swerves the paper from the paper conveying passage; a paper re-feeding device for feeding the received paper into the paper conveying passage at a position upstream of the transfer zone; and a paper returning device for returning the swerved paper to the paper re-feeding device while its front and back surfaces are reversed, the swerved paper having been swerved from the paper conveying passage by the paper swerving device held at the operating position. Thus, the apparatus can produce an image on both surfaces of the paper as required.

41 Claims, 12 Drawing Figures

ELECTROSTATIC COPYING APPARATUS

FIELD OF THE INVENTION

This invention relates to an electrostatic copying apparatus which can produce an image on both surfaces of a copying paper as required.

DESCRIPTION OF THE PRIOR ART

It is frequently desired to produce an image on both surfaces of a copying paper in order to save copying paper sheets and reduce the number of documents to be kept. In recent years, therefore, electrostatic copying apparatuses have been proposed and come into commercial acceptance which can produce an image on both surfaces of a copying paper as required.

In the production of an image on both surfaces of a copying paper, an image is transferred and fixed to one surface of the copying paper while it is being conveyed through a predetermined copying paper conveying passage. The copying paper is then returned while its front and back surfaces are reversed. It is again passed through the conveying passage, and an image is transferred and fixed to the other surface of the copying paper.

The conventional electrostatic copying apparatuses of this type, however, have the following problems or defects to be solved or eliminated.

(1) A mechanism for enabling an image to be produced on both surfaces of a copying paper is considerably complex and expensive and bulky as well. Hence, the electrostatic copying apparatuses as a whole are complex and expensive and of considerably large size.

(2) They differ greatly in structure from electrostatic copying apparatuses for producing an image only on one surface of a copying paper and cannot easily share various constituent elements with the latter.

(3) The versatility of the copying mode (for example, the selectability of the paper size) in the case of producing an image only on one surface of a copying paper is reduced in the copying apparatuses capable of producing an image on both surfaces of a copying paper because these apparatuses are adapted for production of an image on both surfaces of the copying paper.

SUMMARY OF THE INVENTION

A first object of this invention is to provide a novel and excellent electrostatic copying apparatus which is relatively simple and inexpensive and relatively small-sized as well and which as required, can produce an image on both surfaces of a copying paper.

A second object of this invention is to provide a novel and excellent electrostatic copying apparatus capable of producing an image on both surfaces of a copying sheet as required, which can be constructed by separably combining an additional mechanism with a conventional electrostatic copying apparatus for producing an image only on one surface of a copying sheet with or without making some changes thereto.

A third object of this invention is to provide a novel and excellent electrostatic copying apparatus capable of producing an image on both surfaces of a copying paper as required, in which the versatility of the copying mode in the case of producing an image only on one surface of a copying paper is not reduced but increased.

According to this invention, there is provided an electrostatic copying apparatus comprising a main housing, an electrostatic photosensitive member disposed within the main housing and adapted to be moved through an endless moving passage, a latent electrostatic image-forming zone, a developing zone and a transfer zone defined successively in the moving direction of the photosensitive member along the endless moving passage, means for forming a latent electrostatic image on the photosensitive member in the latent electrostatic image-forming zone, a developing means for developing the latent electrostatic image on the photosensitive member to a toner image in the developing zone, a copying paper feeding means, a copying paper receiving means, a copying paper conveying means for conveying a copying paper through a copying paper conveying passage extending from the paper feeding means to the paper receiving means via the transfer zone, a transfer means for transferring the toner image on the photosensitive member to the copying paper in the transfer zone, and a fixing means for fixing the toner image on the copying paper, said fixing means being disposed at that position of the paper conveying passage which is downstream of the transfer zone; said apparatus further including a copying paper swerving means disposed within the paper conveying passage and between the fixing means and the paper receiving means and adapted to be selectively held at a non-operating position at which it permits the copying paper to be discharged into the paper receiving means tnrough the paper conveying passage and an operating position at which it swerves the copying paper from the paper conveying passage, a paper re-feeding means for feeding the received copying paper into the paper conveying passage at a position upstream of the transfer zone, and a copying paper returning means for returning the swerved copying paper to the paper re-feeding means while its front and back surfaces are reversed, said swerved copying paper having been swerved from the paper conveying passage by the paper swerving means held at the operating position.

Other objects of this invention and various technical advantages obtained by this invention will become apparent from the following detailed description made with reference to the accompanying drawings.

DETAILED DESCRIPTION OF PREFERRED EMBODIMENTS

The preferred embodiments of the electrostatic copying apparatus constructed in accordance with this invention will be described in detail below with reference to the accompanying drawings.

Figure 1:
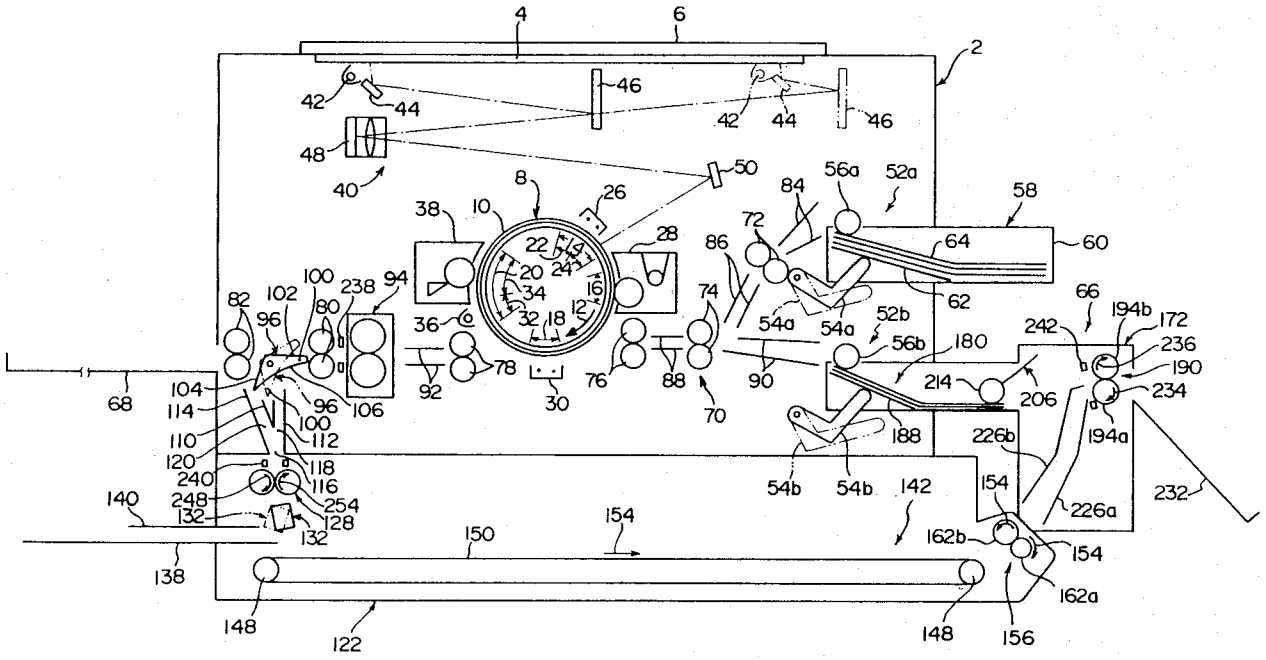
FIG. 1 is a simplified sectional view showing the electrostatic copying apparatus constructed in accordance with this invention as a whole.

With reference to FIG. 1, the illustrated electrostatic copying apparatus has a nearly rectangular pararellpipedal main housing 2. On the upper surface of the main housing 2 is disposed a stationary transparent plate 4 on which to place a document (not shown) to be copied. An openable document holding member 6 for covering the transparent plate 4 and the document thereon is also provided on the upper surface of the main housing 2.

A rotating drum 8 is rotatably mounted at the nearly central portion of the inside of the main housing 2, and an electrostatic photosensitive member 10 is disposed on the peripheral surface of the rotating drum 8. The rotating drum 8 is adapted to be rotated in the direction shown by an arrow 12 whereby the photosensitive member 10 is moved through an endless circular moving passage defined by the peripheral surface of the rotating drum 8. If desired, an endless belt having a photosensitive member disposed on its surface may be used instead of the rotating drum. Around the rotating drum 8 are defined a latent electrostatic image-forming zone 14, a developing zone 16, a transfer zone 18 and a cleaning zone 20 in this order as viewed in the direction of arrow 12. The latent electrostatic image-forming zone 14 includes a charging zone 22 and an exposing zone 24, and a charging corona discharge device 26 is disposed in the charging zone 22. A developing device 28 is located in the eveloping zone 16, and a transfer corona discharge device 30 is disposed in the transfer zone 18. The cleaning zone 20 includes a charge eliminating zone 32 and a residual toner removing zone 34. A charge eliminating lamp 36 is provided in the charge eliminating zone 32, and a residual toner removing device 38 is disposed in the residual toner removing zone 34.

An Optical unit shown generally at 40 is disposed above the rotating drum 8. The optical unit 40 includes a movable document illuminating lamp 42, a movable first reflecting mirror 44, a movable second reflecting mirror 46, a stationary in-mirror lens 48 and a stationary third reflecting mirror 50. The document illuminating lamp 42, the first reflecting mirror 44 and the second reflecting mirror 46 are adapted for reciprocation between the position shown by a solid line and the position shown by a two-dot chain line. During scanning and exposure, the document illuminating lamp 42 and the first reflecting mirror 44 are moved at a predetermined speed to the right from the position shown by a solid line, and the second reflecting mirror 46 is moved at a speed half of the aforesaid predetermined speed to the right from the position shown by a solid line. As a result, a document placed on the transparent plate 4 is illuminated and scanned by the lamp 42, and the reflecting light from the document is projected onto the photosensitive member 10 in the exposing zone 24 via the first reflecting mirror 44, the second reflecting mirror 46, the in-mirror lens 48 and the third reflecting mirror 50.

In the right end portion of the main housing 2 are formed two vertically spaced copying paper cassette receiving sections, i.e an upper copying paper cassette receiving section 52*a* and a lower copying paper cassette receiving section 52*b*. Push-up means 54*a* and 54*b* and delivery rollers 56*a* and 56*b* thereabove are provided respectively in the receiving sections 52*a* and 52*b*. Each of the push-up means 54*a* and 54*b* is selectively held at its operating position shown by a solid line and at its non-operating position shown by a two-dot chain line by a suitable means (not shown). On the paper cassette receiving section 52*a* is detachably mounted an ordinary copying paper cassette 58 which in cooperation with it constitutes a copying paper feeding means. The paper cassette 58 has a box-like case 60, a carrier plate 62 whose rear end portion is pivotably connected to the bottom wall of the case 60 and a layer of copying paper sheets 64 whose front half portion is placed on the carrier plate 62. The push-up means 54*a* at its operating position projects into the case 60 through an opening formed in the bottom wall of the case 60 and elastically biases the carrier plate 62 and the paper layer 64 upwardly to push the uppermost copying paper of the paper layer 64 against the delivery roller 56*a*. As a result, by the rotation of the delivery roller 56*a*, the paper sheets are delivered one by one from the cassette case 60. In FIG. 1, an assembly shwon generally at 66 (which will be described in detail hereinbelow) is detachably mounted on the lower paper cassette receiving section 52*b* instead of an ordinary paper cassette.

To the left end of the main housing 2 is detachably mounted a copying paper receiving means 68 which may be a receiving tray. A copying paper conveying means shown generally at 70 is also provided within the main housing 2. The paper conveying means 70 includes conveying roller units 72, 74, 76, 78 and 80, and a discharge roller unit 82. A pair of guide plates 84 are disposed between the paper cassette receiving section 52*a* and the conveying roller unit 72, and a pair of guide plates 86 are disposed between the conveying roller unit 72 and the conveying roller unit 74. Furthermore, a pair of guide plates 88 are provided between the conveying roller unit 74 and the conveying roller unit 76. A pair of guide plates 90 are disposed between the paper cassette receiving section 52*b* and the conveying roller unit 74. Downstream of the conveying roller unit 78 are located a pair of guide plates 92. A fixing means 94 which may be of the heating and pressing type is disposed between the guide plate pair 92 and the conveying roller unit 80.

The above structure of the illustrated elelctrostatic copying apparatus except the assembly 66 may be the same as in known electrostatic copying apparatuses for forming an image only on one surface of a copying paper. A detailed description of this known structure is therefore omitted in the present specification.

The following improvement is made in the illustrated electrostatic copying apparatus of this invention in order to enable an image to be formed on both surfaces of a copying paper as required.

Figure 2:
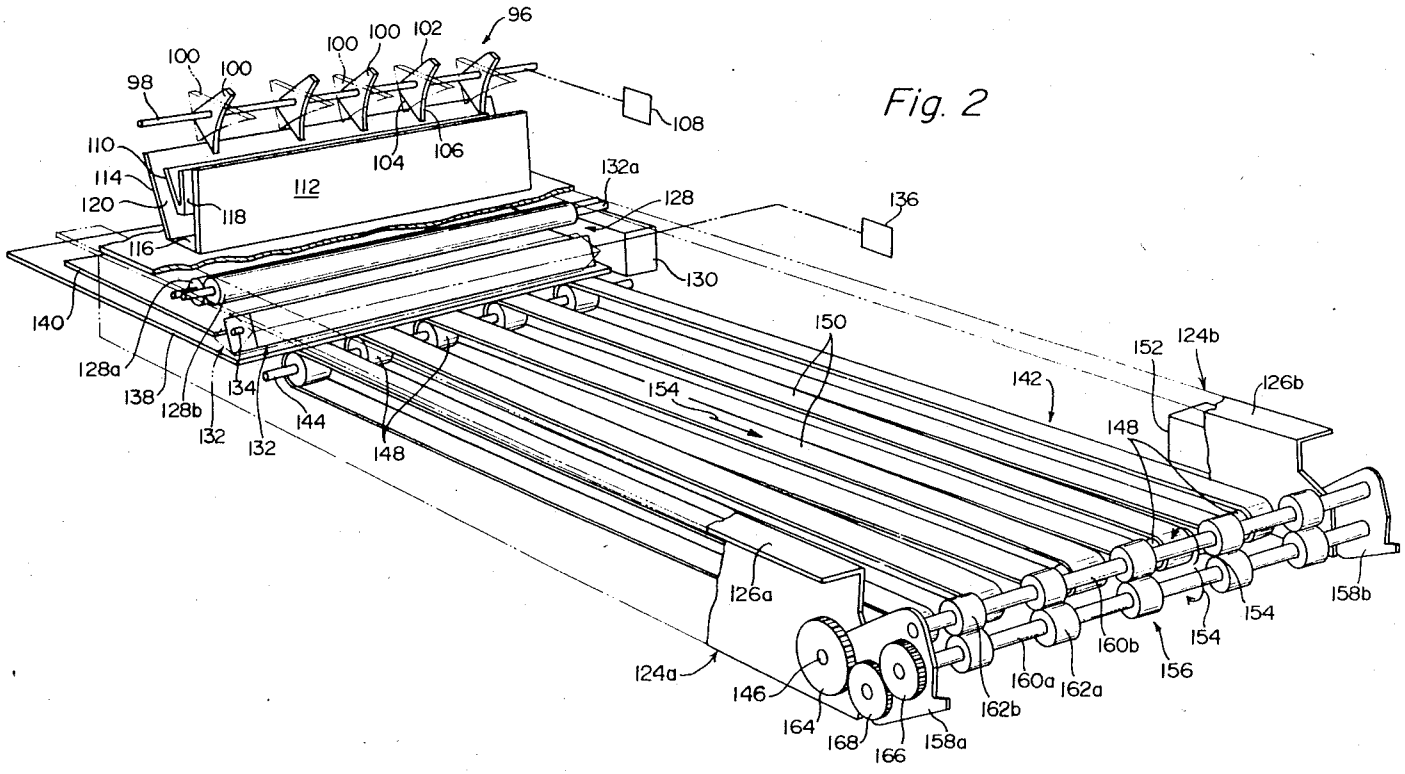
FIG. 2 is a partly broken-away perspective view showing a copying paper swerving means, a copying paper returning means and related means in the electrostatic copying apparatus of FIG. 1.

With reference to FIG. 2 as well as FIG. 1, a copying paper swerving means 96 is disposed between the conveying roller unit 80 and the discharge roller unit 82. The illustrated paper swerving means 96 is comprised of a shaft 98 mounted rotatably at a predetermined position within the main housing 2 and a plurality of swerving members 100 fixed to the shaft 98 and spaced from each other in the axial direction (the direction perpendicular to the sheet surface in FIG. 1). Each of the swerving members 100 is nearly triangular and has nearly flat guide surfaces 102 and 104 and a swerving surface 106 curved in a concave shape. A suitable positioning means 108 such as an electromagnetic solenoid is connected to the shaft 98. When the positioning means 108 is in the deenergized state, the paper swerving means 96 is held at its non-operating position shown by a solid line in FIG. 1 and a two-dot chain line in FIG. 2. When it is energized, it is rotated to its operating position shown by a two-dot chain line in FIG. 1 and a solid line in FIG. 2. It will be readily understood from FIG. 1 that when the paper swerving means 96 is held at the non-operating position, a copying paper from the conveying roller unit 80 is guided by the guiding surface 102 and conducted to the discharge roller unit 82. When the swerving means 96 is held at the operating position, the paper from the conveying roller unit 80 abuts against the swerving surface 106 and is swerved downwardly by the action of the swerving surface 106.

Guide members 110, 112 and 114 are fixed in position below the paper swerving means 96. These guide members 110, 112 and 114 define a guide passage 118 extending from the swerving surface 106 of the paper swerving means 96 held at its operating position to an opening 116 formed in the bottom wall of the main housing 2 and a return guide passage 120 extending from the downstream portion, i.e. the lower end portion, of the guide passage 118 to a position immediately upstream of the discharge roller unit 82.

Further, with reference to FIGS. 1 and 2, a subsidiary housing 122 having a relatively low height is separably combined with the underside of the main housing 2. As shown in FIG. 2, in the subsidiary housing 122, upstanding side plates **124*a* and 124*b* spaced from each other in the widthwise direction (the direction perpendicular to the sheet surface in FIG. 1) are disposed, and horizontal supporting walls 126*a* and 126*b* projecting substantially horizontally and outwardly in the widthwise direction are formed respectively at the upper ends of the side plates 124*a* and 124*b*. The main housing 2 is placed on rhe horizontal supporting walls 126*a* and 126*b*, and is releasably connected to the horizontal supporting walls 126*a* and 126*b*** by a suitable connecting means (not shown) such as bolts and nuts.

Between the side plates **124*a* and 124*b* within the subsidiary housing 122 is mounted a conveying direction controlling roller unit 128 located adjacent the opening 116 (FIG. 1) formed in the bottom wall of the main housing 2. The conveying direction controlling roller unit 128 is comprised of a driven roller 128*a* and a follower roller 128*b*. At the back of the side plate 124*b* is disposed a driving source 130 which may be a reversible electric motor. The shaft 132*a* of the driven roller 128*a* is drivingly connected to the driving source 130. In the illustrated embodiment, the shaft of a driven roller of tne discharge roller unit 82 mounted within the main housing 2 is also drivingly connected to the driving source 130 by a suitable power transmission means (not shown). Accordingly, the conveying direction controlling roller unit 128 and the discharge roller unit 82 are adapted to be driven by the driving source 130 (movable elements disposed within the main housing 2, such as rhe rotating drum 8, the document illuminating lamp 42 and the first and second reflecting mirrors 44 and 46 of the optical unit 40, the delivery rollers 56*a* and 56*b*, the conveying roller units 72, 74, 76, 78 and 80 and the fixing means 94 are drivingly connected to a main driving source (not shown) which may be an electric motor disposed within the main housing 2, through a suitable clutch means or the like, and driven by this main driving source). A movable copying paper guiding means 132 is provided below the conveying direction controlling roller unit 128. As clearly shown in FIG. 2, the movable copying paper guiding means 132 is formed of a box-like member having an open upper end and an open lower end and rotatably mounted between the side plates 124*a* and 124*b* by rotatably fitting pins 134 fixed in both sides of the box-like member in the side plates 124*a* and 124*b*. A suitable positioning means 136 such as an electromagnetic solenoid is connected to the copying paper guiding means 132. When the positioning means 136 is in the deenergized state, the paper guiding means 132 is held at a first position shown by a solid line in FIGS. 1 and 2. When the positioning means 136 is energized, the paper guiding means 132 is held at a second position shown be a two-dot chain line in FIGS. 1 and 2. Guide plates 138 and 140 are fixed in position between the side plates 124*a* and 124*b* in relation to the lower end of the paper guiding means 132 at its second position. The guide plate 138 extends from its inside end opposite to the lower end of the paper guiding means 132 in its second position to the left in FIG. 1, and the guide plate 140 extends above and along the guide plate 138. Hence, when the paper guiding means 132 is held at the second postion, a copying paper discharged from the lower end of the paper guiding means 132 is moved to the left in FIG. 1 by being guided by the guide plates 138 and 140**.

A copying paper returning means shown generally at 142 is further provided between the side plates **124*a* and 124*b* in the subsidiary housing 122. With reference to FIG. 2, shafts 144 and 146 spaced from each other in the lateral direction (in the left-right direction in FIG. 1) are rotatably mounted across the side plates 124*a* and 124*b*. A plurality of axially spaced pulleys 148 are fixed to each of the shafts 144 and 146, and endless belts 150 are wrapped about the pulleys 148. A driving source 152 which may be an electric motor is disposed rearwardly of the side plate 124*b*, and the shaft 146 is drivingly connected to the driving source 152. When the driving source 152 is energized, the endless belts 150 are driven in the direction shown by an arrow 154. One end portion, i.e. the left end portion in FIG. 1, of the upper running section of each endless belt 150 is positioned immediately below the lower end of the paper guiding means 132 in its first position. When, therefore, the paper guiding means 132 is held at the first position, a copying paper discharged from the lower end of the paper guiding means 132 is conducted to the upper running sections of the endless belts 150 and then conveyed in the direction shown by arrow 154 by the action of the endless belts 150 driven in the direction of arrow 154. In the illustrated embodiment, a return roller unit 156 is further provided in the right end portion in FIG. 1 of the subsidiary housing 122. With reference to FIG. 2, a supporting member 158***a* or 158*b* is mounted on one end portion of the side plate 124*a* or 124*b*, respectively. Conveniently, each of the supporting members 158*a* and 158*b* is mounted on the side plate 124*a* or 124*b* so that its rotating angular position formed with the rotating central axis of the shaft 146 as a center can be freely adjusted. Shafts 160*a* and 160*b* are rotatably mounted across the supporting members 158*a* and 158*b*, and a plurality of rollers 162*a* or 162*b* are fixed to the shaft 160*a* or 160*b*. One end of the shaft 146 projects forwardly beyond the side plate 124*a*, and a gear 164 is fixed to this one end. One end of the shaft 160*a* projects forwardly beyond the supporting member 158*a*, and a gear 166 is fixed to this one end. A gear 168 in mesh with both the gears 164 and 166 is rotatably mounted on the supporting member 158*a*. Accordingly, when the shaft 146 is driven in the direction of arrow 154 by the driving source 152, the return roller unit 156 is rotated in the direction of arrow 154 via the gears 164, 168 and 166. The return roller unit 156 nips the copying paper conveyed by the endless belts 150 and sends it between guide plates provided in the assembly 66 (FIG. 1) to be described below in detail. The position of the return roller unit 156 with respect to the introduction end of the pair of guide plates in the assembly 66 can be adjusted as desired by adjusting the rotating angular positions of the supporting members 158*a* and 158*b*.

Figure 3:
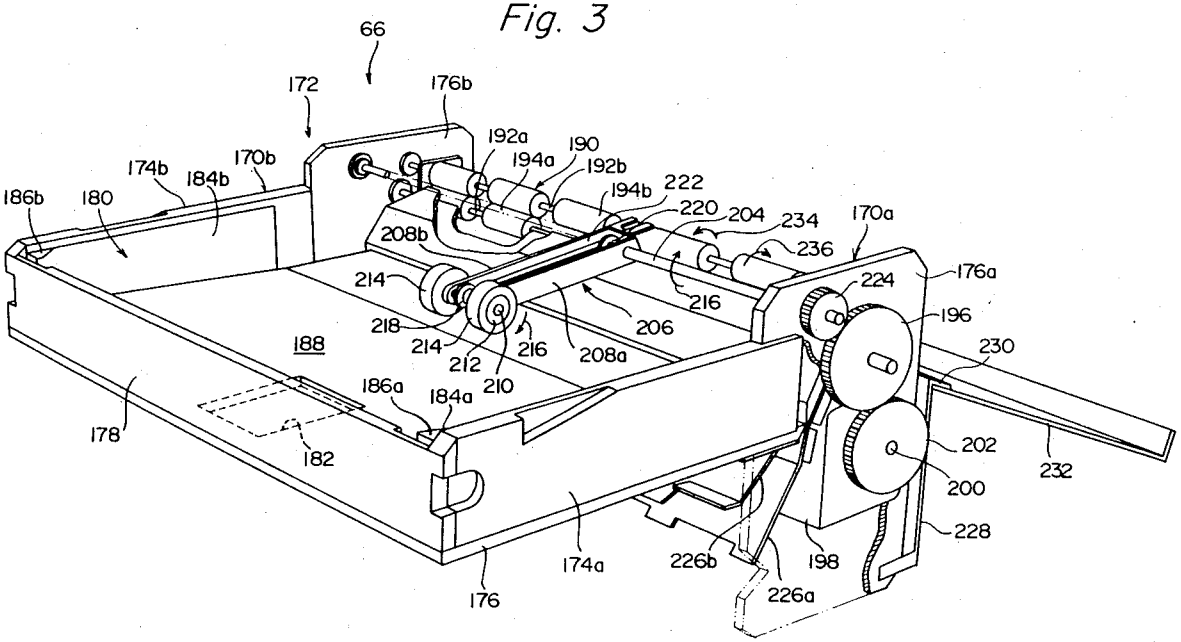
FIG. 3 is a partly broken-away perspective view showing an assembly in the electrostatic copying apparatus of FIG. 1.

Now, with reference to FIGS. 1 and 3, a detailed description will be made of the assembly 66 which is mounted detachably instead of an ordinary copying paper cassette on the lower copying paper cassette receiving section 52*b* formed at tne right end portion of the main housing 2. The assembly 66 includes a supporting frame 172 having side walls 170*a* and 170*b* spaced from each other in the widthwise direction (the direction perpendicular to the sheet surface in FIG. 1). The side walls 170*a* and 170*b* respectively have nearly rectangular front portions 174*a* and 174*b* extending laterally (in the left-right direction in FIG. 1) and nearly rectangular rear portions 176*a* and 176*b* extending vertically. A bottom wall 176 is fixed across the lower end edges of the front portions 174*a* and 174*b* of the side walls 170*a* and 170*b*. A front wall 178 is fixed across the front end edges of the front portions 174*a* and 174*b* of the side walls 170*a* and 170*b*. As a result, a box-like copying paper receiving receptacle 180 having an open upper surface and an open rear surface is defined by the front portions 174*a* and 174*b* of the side walls 170*a* and 170*b* and the bottom wall 176 and the front wall 178. The bottom wall 176 has an opening 182 through which the push-up means 54*b* disposed in the lower paper cassette receiving section 52*b* can extend. Plate-like members 184*a* and 184*b* are disposed inwardly of the front portions 174*a* and 174*b* of the side walls 170*a* and 170*b* respectively, and separating claws 186*a* and 186*b* are formed as an integral unit on the front end and upper end of the plate-like members 184*a* and 184*b*, respectively. The rear end portions of the plate-like members 184*a* and 184*b* are pivotably connected to the front portions 174*a* and 174*b* of the side walls 170*a* and 170*b* respectively, and the plate-like members 184*a* and 184*b* can freely pivot over some angular range (the pivotal movement of the plate-like members 184*a* and 184*b* is restricted by the contacting of suitable contacting portions (not shown) defined in the plate-like members 184*a* and 184*b* with the upper surface of the bottom wall 176). Hence, the separating claws 186*a* and 186*b* can move up and down freely over some range. A carrier plate 188 is disposed between the plate-like members 184*a* and 184*b*. The rear end of the carrier plate 188 is pivotably connected to the bottom wall 176. The structure of the paper receiving receptacle 180 itself including the plate-like members 184*a* and 184*b* and the carrier plate 188 is substantially the same as that of a known copying paper case in an ordinary copying paper cassette. Accordingly, a detailed description of the paper receiving receptacle 180 itself will be omitted in the present specification.

A carrying roller unit 190 is disposed between the upper end portions of the rear portions 176*a* and 176*b* of the side walls 170*a* and 170*b*. More specifically, shafts 192*a* and 192*b* are rotatably mounted across the rear portions 176*a* and 176*b* of the side walls 170*a* and 170*b*, and a plurality or rollers 194*a* and 194*b* are fixed respectively to the shafts 192*a* and 192*b*. One end of the shaft 192*a* projects forwardly beyond the rear portion 176*a* of the side wall 170*a*, and a gear 196 is fixed to this one end. Furthermore, a driving source 198 which may be a reversible electric motor is fixed to the inside of the rear portion 176*a* of the side wall 170*a*. The output shaft 200 of the driving source 198 also projects forwardly beyond the rear portion 176*a* of the side wall 170*a*, and a gear 202 is fixed to the projecting end of the output shaft 200. The gear 202 is in mesh with the gear 196. Hence, the carrying roller unit 190 is rotated by the driving source 198. A shaft 204 is further mounted rotatably across the rear portions 176*a* and 176*b* of the side walls 170*a* and 170*b*, and a pivoting member 206 is pivotably mounted on the center of the shaft 204. The pivoting member 206 has portions 208*a* and 208*b* inclined forwardly and extending downwardly from the shaft 204 while being spaced from each other substantially parallel to each other. A shaft 210 is rotatably mounted on the free end portions of the portions 208*a* and 208*b*. To both ends of the shaft 210 is mounted a roller 214 via a one-way clutch 212. The one-way clutch 212 transmits the rotation of the shaft 210 to the roller 214 only when the shaft 210 is rotated in the direction shown by an arrow 216. A pulley 218 is fixed to the center of the shaft 210, and a pulley 220 is also fixed to that part of the shaft 204 which is between the portions 208*a* and 208*b* of the pivoting member 206. An endless belt 222 is wrapped about the pulleys 218 and 220. One end of the shaft 204 projects forwardly beyond the rear portion 176*a* of the side wall 170*a*, and a gear 224 is fixed to this one end. The gear 224 is in mesh with the gear 196. Accordingly, the shafts 204 and 210 are also rotated by the driving source 198. When the shaft 210 is rotated in the direction of arrow 216, the roller 214 is rotated in the direction shown by arrow 216. The pivoting member 206 and the rollers 214 mounted thereon, which constitute an auxiliary advancing means, are biased downwardly by their own weight, and consequently, the rollers are brought into contact with the upper surface of the bottom wall 176 of the paper receiving receptacle 180.

A pair of guide plates 226*a* and 226*b* inclined slightly forwardly and extending downwardly from their upper ends approximating the nipping portion of the carrying roller unit 190 are fixed across the rear end portions 176*a* and 176*b* of the side walls 170*a* and 170*b*. A rear wall 228 is fixed across the rear end edges of the rear portions 176*a* and 176*b* of the side walls 170*a* and 170*b*. A rearwardly extending projecting portion 230 is formed as a unit at the upper end of the rear wall 228 which is located slightly below the nipping position of the carrying roller unit 190. An additional copying receiving means 232 which may be a receiving tray is detacnably mounted on the projecting portion 230.

When as shown in FIG. 1 the assembly 66 is mounted on the lower paper cassette receiving section **52*b* formed in the main housing 2, the lower ends of the guide plates 226*a* and 226*b* stand opposite to the return roller unit 156 of the paper returning means 142 provided in the subsidiary housing 122. Consequently, the copying paper discharged from the return roller unit 156 is introduced between the guide plates 226*a* and 226*b* and guided by the carrying roller unit 190. The copying paper is conveyed rearwardly in a direction away from the paper receiving receptacle 180 while it is nipped by the carrying roller unit 190 rotated normally (i.e., in the direction of an arrow 234). When the carry roller unit 90 continues to rotated normally, the copying paper is discharged into the additional paper receiving means 32. However, when the copying paper is to be carried into the paper receiving receptacle 180, the carry roller unit 190 is rotated reversely, namely in the direction of an arrow 236, immediately after the trailing end of the copying paper has left the upper ends of the guide plates 226*a* and 226*b* and while the trailing end portion of the copying paper is still nipped by the carrying roller unit 190. As a result, the copying paper is conveyed with its leading and trailing ends reversed, and carried into the paper receiving receptacle 180 after passing above the guide plates 226*a* and 226*b*. Tne copying paper carried into the paper receiving receptacle 180 introduced between the bottom wall 176 and the rollers 214, and its advancing is promoted by the action of the rollers 214 rotated in the direction of arrow 216. Consequently, the copying paper is advanced until its leading portion is placed on the carrier plate 188 and its leading edge abuts against the front wall 178**.

In relation to the aforesaid improvement made in order to enable an image to be formed on both surface of the copying paper as required, the illustrated electrostatic copying paper further has a detecting means to be described. As shown in FIG. 1, a paper stacking detecting means 238 is provided between the fixing means 94 and the conveying roller unit 80. The detector 238 which can be constructed of a light receiving element and a light emitting element and may be of a known type detects the state of stacking of two or more copying paper sheets (at which time the light transmittance of the copying paper sheets is below a predetermined threshold value) and produces an output signal. As shown in FIG. 1, a copying paper detector 240 is provided immediately upstream of the conveying direction controlling roller unit 128, and as also shown in FIG. 1, a copying paper detector 242 is also provided immediately upstream of the carrying roller unit 190. These detectors 240 and 242 each of which may be constructed of a light receiving element and a light emitting element and be of a known type detect the leading edge of the copying paper and produce an output signal. The output signals produced by the detectors 238, 240 and 242 are fed into a control means 244 (FIG. 4) for controlling the operation of the electrostatic copying apparatus. The control means may be a microprocessor.

Now, with reference mainly to FIG. 1, the operation of the electrostatic copying apparatus described above will be described.

In the illustrated electrostatic copying apparatus, the rotating drum 8 is rotated in the direction of arrow 12. In the charging zone 22, the surface of the photosensitive member 10 on the rotating drum is charged to a specific polarity by the charging corona discharge device 26. In the exposing zone 24, the image of a document placed on the transparent plate 4 is scanned by the optical unit 40 and projected onto the photosensitive member 10. As a result, a latent electrostatic image corresponding to the image of the document is formed on the photosensitive member 10. In the developing zone 16, a toner is applied to the latent electrostatic image on the photosensitive member 101 by the deveIoping device 28 to develop the latent electrostatic image to a toner image. In the transfer zone 18, a copying paper conveyed through the transfer zone 18 (the conveying of the copying paper will be described hereinafter) is brought into contact with the surface of the photosensitive member 10, and by the action of the transfer corona discharge device 30, the toner image on the photosensitive member 10 is transferred to the upper surface of the copying paper. The copying paper having the toner image transferred thereto is peeled off from the surface of the photosensitive member 10 and conveyed to the fixing means 94 where the toner image is fixed to the upper surface of the copying paper. In the charge eliminating zone 32, light from the charge eliminating lamp is irradiated onto the photosensitive member 10, and a residual charge on the photosensitive member 10 is erased. In the residual toner removing zone 34, the residual toner is removed from the surface of the photosensitive member 10 by the residual toner removing device 38.

Conveying of the copying paper is described below.

(1) When an image is to be formed only on one surface of the copying paper:

In this case, the paper swerving means 96 is held at its non-operating position shown by a solid line in FIG. 1. In this condition, the copying paper delivered from the paper cassetter 58 mounted on the upper paper cassette receiving section **52*a* is conveyed through the transfer zone 18 and the fixing means 94 (therefore, an image is produced on the upper surface of the paper). Then, it is conveyed over the guide surface 102 of the paper swerving means 96 and discharged into the paper receiving means 68. If desired, it is possible to detach the assembly 66 mounted on the lower paper cassette receiving section 52*b*, mount an ordinary copying paper cassette also on the lower paper cassette receiving section 52*b*, and deliver a copying paper selectively from either one of the cassette 58 mounted on the cassette receiving section 52*a* and the cassette mounted on the lower cassette receiving section 52*b*. In this case, the copying paper sheets in the cassette 58 may be different in size from those placed in the cassette mounted on the cassette receiving section 52*b***.

Figure 4:
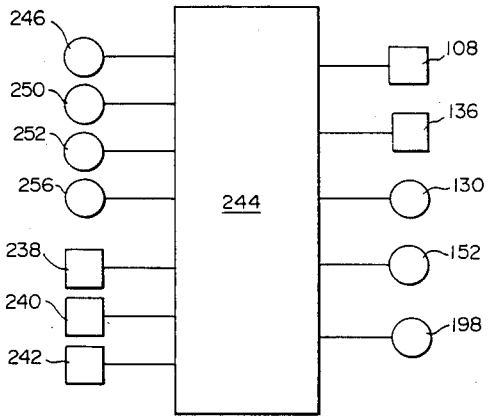
FIG. 4 is a block diagram showing part of a control circuit used in the electrostatic copying apparatus of FIG. 1.

(2) When an image is to be formed on both surfaces of the copying paper:

When it is desired to produce an image on both surfaces of the copying paper, a copying paper return switch 246 (FIG. 4) provided in an operating panel (not shown) disposed on the upper or front surface of the main housing 2 is manually operated. As a result, the paper swerving means 96 is held at the operating position shown by a two-dot chain line in FIG. 1 and a solid line in FIG. 2. Furthermore, the push-up means **54*b* provided in the lower paper cassette receiving section 52*b* is held at the non-operating position shown in FIG. 1 by a two-dot chain line. The movable copying paper guiding means 132 is held at the first position shown by a solid line in FIGS. 1 and 2. When the copying cycle is then started, a copying paper which has been delivered from the paper cassette 58 mounted on the cassette receiving section 52***a* and transferred through the transfer zone 18 and the fixing means 94 and thus has an image formed on its upper surface abuts against the swerving surface 106 of the paper swerving means 96 on the downstream side of the conveying roller unit 80. Consequently, the copying paper is swerved downwardly without being discharged into the paper receiving means 68. The copying paper which has been swerved downwardly is moved along the guide passage 118 and sent to the conveying direction controlling roller unit 128 which is normally rotated (i.e., in the direction of arrow 248) by the driving source 130 (FIG. 2). The conveying direction controlling roller unit 128 sends the copying paper to the endless belts 150 of the paper returning means 142 through the movable paper guiding means 132. It will be easily understood by reference to FIG. 1 that when the paper has been fed to the endless belts 150 as above, the copying paper is turned upside down and placed on the endless belts 150 with its image-bearing surface 113 directed downwardly. The endless belts 150 are driven in the direction of arrow 154 by the driving source 152 (FIG. 2), and send the copying paper in the direction of arrow 154 to the return roller unit 156. The return roller unit 156 rotating in the direction of arrow 154 by the driving source 152 (FIG. 2) introduces the copying paper between the guide plates 226*a* and 226*b* provided in the assembly 66, and sends it to the carrying roller unit 190 between the guide plates 226*a* and 226*b*. At this time, the carrying roller unit 190 is rotated normally (i.e. in the direction of arrow 234) by the driving source 198 (FIG. 3). Hence, the copying paper nipped by the carrying roller unit 190 is conveyed rearwardly, i.e. in a direction away from the paper receiving receptacle 180. In the meantime, the detector 242 disposed immediately upstream of the carrying roller unit 190 detects the leading edge of the copying paper and produces an output signal. After the lapse of a predetermined delay time from the production of the output signal by the detector 242, the control means 244 (FIG. 4) reverses the rotation of the driving source 198. At this time, the trailing end of the copying paper conveyed rearwardly by the carrying roller unit 190 has already gone past the guide plates 226*a* and 226*b*, but its trailing end portion is still nipped by the carrying roller unit 190. The delay time can be prescribed by a timer built in the control means 244. When the rotation of the driving source 198 (FIG. 3) is reversed, the carrying roller unit 190 is reversed, namely rotated in the direction of an arrow 236. As a result, the copying paper is conveyed forwardly with its leading and trailing ends reversed, passed above the guide plates 226*a* and 226*b*, and carried into the paper receiving receptacle 180. The copying paper is advanced by the action of the rollers 214 rotated in the direction of arrow 216 by the driving source 198. Thus, its leading portion is introduced and placed on the carrier plate 188, and its leading edge is brought into abutment against the front wall 178. Thereafter, the driving source 198 (FIG. 3) is again caused to rotate normally. Returning of the driving source 198 to a normally rotating condition may be effected at a time after the lapse of a relatively long predetermined delay time from the production of the output signal by the detector 242. This delay time can also be prescribed by a timer built in the control means 244 (FIG. 4).

As is well known to those skilled in the art, two or more paper sheets may be delivered in the stacked state from the paper cassette 58 mounted on the upper cassette receiving section 52*a* although this rarely happens. In this case, the detector 238 disposed downstream of the fixing means 94 detects the stacked copying paper sheets and produces an output signal. When the detector 238 produces an output signal, the driving source 198 is not reversed even after the lapse of the aforesaid predetermined delayed time from the time when the detector 242 located immediately upstream of the carrying roller unit 190 detects the leading edge of the copying paper and produces an output signal. Hence, the carrying roller unit 190 continues to be normally rotated in the direction of arrow 234. The stacked copying paper sheets are therefore not carried into the paper receiving receptacle 180, but discharged into the additional paper receiving means 232.

When one or more copying paper sheets are carried into the paper receiving receptacle 180, the operator manually operates a re-feeding switch 250 (FIG. 4) provided in the operating panel (not shown). As a result, the paper swerving means 96 is returned to the non-operating position shown by a solid line in FIG. 1 and a two-dot chain line in FIG. 2. Furthermore, the push-up means 54*b* provided in the lower paper cassette receiving section 52*b* is returned to the operating position shown by a solid line in FIG. 1, and therefore, the carrier plate 188 and the copying paper thereon in the paper receiving receptacle 180 are elastically biased upwardly to push the paper against the delivery roller 56*b*. Then, the copying cycle is resumed, and with the rotation of the delivery roller 56*b*, the copying paper is delivered from the paper receiving receptacle 180. The delivered copying paper is conveyed through the transfer zone 18 and the fixing means 94, and an image is formed on the upper surface of the copying paper, namely on that surface which is opposite to that surface on which the image was first formed. The copying paper is conveyed over the guide surface 102 of the paper swerving means 96 at its non-operating position shown by a solid line in FIG. 1 and a two-dot chain line in FIG. 2, and discharged into the paper receiving means 68. Consequently, a copy bearing an image on both surfaces is obtained.

(3) When the copying paper is to be discharged with both its front and back surfaces and its leading and trailing ends reversed:

For example, when a part of a book is to be copied the last page to be copied may sometimes be an odd-numbered page. In this case, an image must be formed on both surfaces of a copying paper (namely the image of an odd-numbered page is formed on one surface of the copying paper and the image of an even-numbered page is formed on the other surface) excepting the last page, and the image of the last page needs to be formed only on one surface of a copying paper. As will be understood from the foregoing description, when an image is to be formed on both surfaces of a copying paper, the copying paper is discharged into the paper receiving means 68 with both its front and back surfaces and its leading and trailing ends reversed. Thus, especially when so-called sorter is used as the paper receiving means 68, it is desired to discharge the copying paper having the image of the final page formed on its one surface into the paper receiving means 68 also with both its front and back surfaces and its leading and trailing ends reversed and thus to set page numbers in the right order. Also, in a usual case of producing an image on one surface of a copying paper, it is sometimes desired to discharge the copying paper bearing an image only on one surface into the paper receiving means 68 with its front and back surfaces and its leading an trailing ends reversed.

In this case, a reverse discharge switch 252 (FIG. 4) provided in the operating panel (not shown) is first manually operated. As a result, the paper swerving means 96 is held at its operating position shown by a two-dot chain line in FIG. 1 and a solid line in FIG. 2, and the movable paper guiding means 32 is held at its second position shown by a two-dot chain line in FIGS. 1 and 2. When the copying cycle is then started, a copying paper which has been delivered from the paper cassette 58 mounted on the upper paper cassette receiving section 52*a* and delivered through the transfer zone 18 and fixing means 94 and thus has an image formed on its upper surface abuts against the swerving surface 106 of the paper swerving means 96 on the downstream side of the conveying roller unit 80. Accordingly, the copying paper is not discharged into the paper receiving means 68 but is swerved downwardly. The copying paper is then moved along the guide passage 18 and sent to the conveying direction controlling roller unit 128 rotated normally in the direction of arrow 248 by the driving source 130 (FIG. 2). The copying paper conveyed by the conveying direction controlling roller unit 128 moves through the movable paper guiding means 132 held at the non-operating position shown by a two-dot chain line in FIGS. 1 and 2. As a result, it is not directed to the paper returning means 142 but guided between the guide plates 138 and 140 in a direction away from the paper returning means 142. In the meantime, the detector 240 disposed immediately upstream of the conveying direction controlling roller unit 128 detects the leading edge of the copying paper and produces an output signal. The control means 244 (FIG. 4) reverses the rotation of the driving source 130 (FIG. 3) after the lapse of a predetermined delay time from the production of the output signal by the detector 240. At this time, the trailing end portion of the copying paper conveyed by the conveying direction controlling roller unit 128 is still nipped by the conveying direction controlling roller unit 128. The delay time can be prescribed by a timer built in the control means 244 (FIG. 4). When the driving source 130 (FIG. 2) is reversed, the conveying direction controlling roller unit 128 is rotated reversely, namely in the direction of arrow 254. In the illustrated embodiment, the discharge roller unit 82 is also drivingly connected to the driving source 130 (FIG. 2). But a suitable reverse rotation transmitting means known per se (not shown) is disposed between the driving source 130 and the discharge roller unit 82, and as soon as the rotation of the driving source 130 is reversed, this reverse rotation transmitting means is actuated. Accordingly, even when the driving source 130 is reversed, the rotating direction of the discharge roller unit 82 is not reversed. When the conveying direction controlling roller unit 128 is rotated in the direction of arrow 254, the copying paper is conveyed upwardly with its leading and trailing edge reversed, and sent to the discharge roller unit 82 through the return guide passage 120. By the action of the discharge roller unit 82, the copying paper is discharged into the paper receiving means 68 with its front and back surfaces reversed. Thereafter, the driving source 130 (FIG. 2) is again returned to its normally rotating condition. Returning of the driving source 130 to its normally rotating condition may be effected at a time after the lapse of a relatively long delay time from the production of the output signal by the detector 240. This delay time can also be prescribed by a timer built in the control means 244 (FIG. 4).

As can be easily understood, when the copying paper is discharged with its front and back surfaces and its leading and trailing ends reversed, the moving length of the copying paper is much larger than in the case of discharging the copying paper as such. Hence, unless some measure is taken, the discharging of the copying paper would be retarded. In a high-speed electrostatic copying apparatus in particular, before the discharging of the copying paper with its front and back surfaces and its leading and trailing ends reversed is completed, a copying paper which is delivered from the copying paper cassette 58 (or from the paper receiving receptacle 180) for the next cycle of copying and is to be discharged as such without reversing may reach the discharge roller unit 82 to cause inconveniences such as paper jamming.

To avoid this problem, in the illustrated electrostatic copying apparatus, the rotating speed of the driving source 130 (FIG. 2) during reverse rotation is made higher than that during normal rotation. Hence, when the conveying direction controlling roller unit 128 is rotated reversely, namely rotated in the direction of arrow 254 and the copying paper is discharged with its front and back surfaces and its leading and trailing ends reversed, the rotating speeds of the conveying direction controlling roller unit 128 and the discharge roller unit 82 are made high. This reduces the delay in the completion of paper discharge when the paper is discharged with its front and back surfaces and its leading and trailing ends reversed.

Instead of, or in addition to, reducing the delay in the completion of paper discharge as above, the above problem may also be avoided by delaying the conveying of the copying paper delivered from the paper cassetter 58 (or from the paper receiving receptacle 180) for the next cycle of copying by at least a certain period of time. This delaying may be performed, for example, by rotating the delivery roller 56*a* (or the delivery roller 56*b*) after the lapse of a longer predetermined period of time from the time when the preceding copying paper has been delivered from the paper cassette 58 mounted on the upper cassette receiving section 52*a*, and thus delivering the copying paper from the cassette 58 (or from the paper receiving receptacle 180) after the lapse the of this period. The above predetermined time can be prescribed by a timer built in the control means 244 (FIG. 4).

(4) In the case of interruption copying:

It is desired to copy one or several documents during the copying of a number of documents by interrupting the latter copying cycle. In this case, the operator manually operates an interruption copying switch 256 (FIG. 4) provided in the operating panel (not shown). As a result, the paper swerving means 96 is held at its operating position shown by a two-dot chain line in FIG. 1 and a solid line in FIG. 2. The movable copying paper guide means 132 is held at the first position shown by a solid line in FIGS. 1 and 2. When the interrupting copying cycle is then started, a copying paper which has been delivered from the cassette 58 mounted on the upper cassette receiving section 52*a* and transferred through the transfer zone 18 and fixing means 94 and thus has an image formed on its upper surface is swerved downwardly by the swerving surface 106 of the paper swerving means 96 on the downstream side of the conveying roller unit 80. The copying paper is sent to the carrying roller unit 190 in the assembly 66 through the conveying direction controlling roller unit 128, the movable paper guiding means 132 and the paper returning means 142 as stated hereinabove. The carrying roller unit 190 is rotated normally in the direction of arrow 234 by the driving source 198 (FIG. 3). It nips the fed copying paper and conveys it rearwardly, namely in a direction away from the paper receiving receptacle 180. In the case of the interrupting copying, the driving source 198 is not rotated reversely even after the lapse of the aforesaid predetermined delay time after the production of the output signal by the detector 242, and therefore, the carrying roller unit 190 continues to rotate normally in the direction of arrow 234. Thus, the copying paper in the interrupting copying cycle is discharged into the additional paper receiving means 232 unlike other copying papers to be discharged into the paper receiving means 68.

Figure 5:
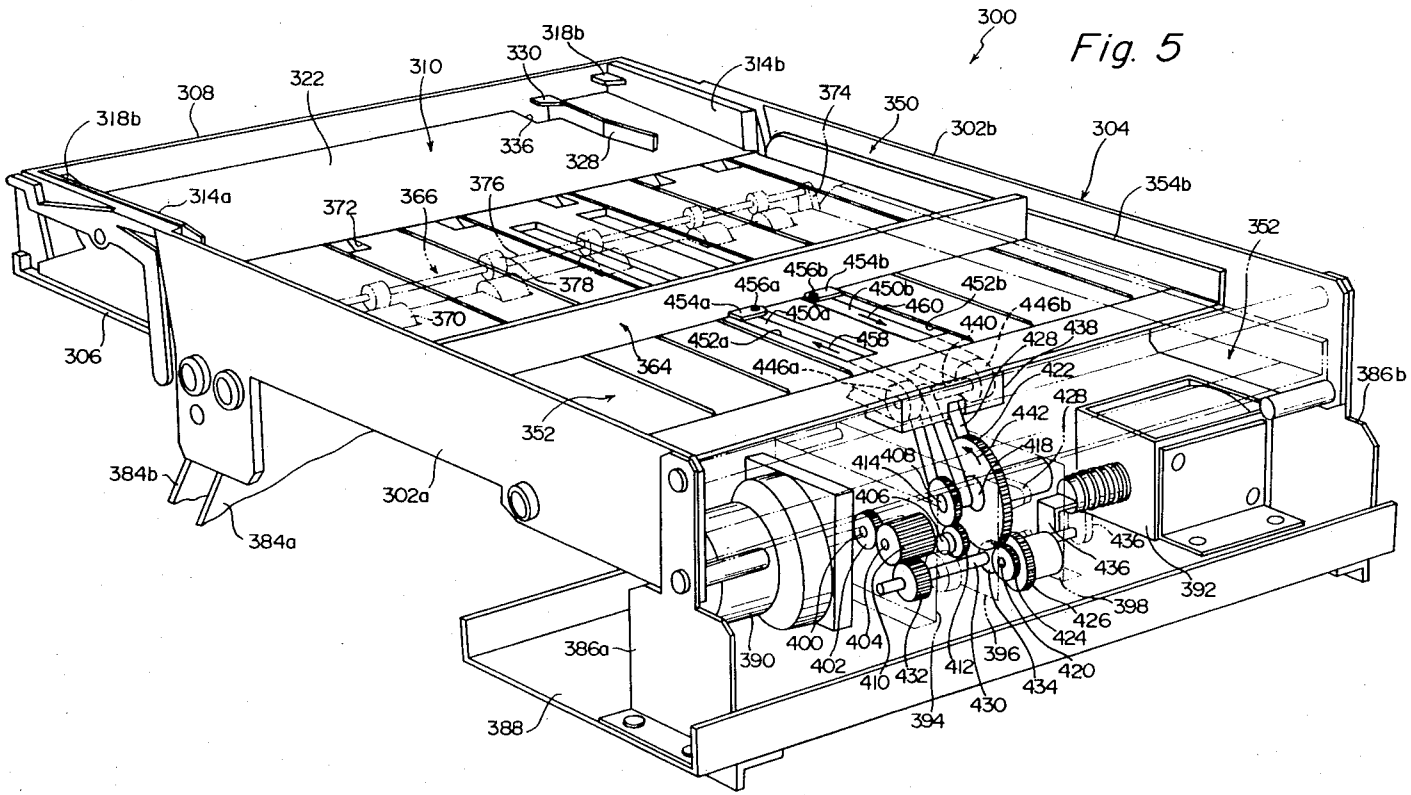
FIG. 5 is a partly broken-away perspective view showing a modified example of the assembly.
Figure 6:
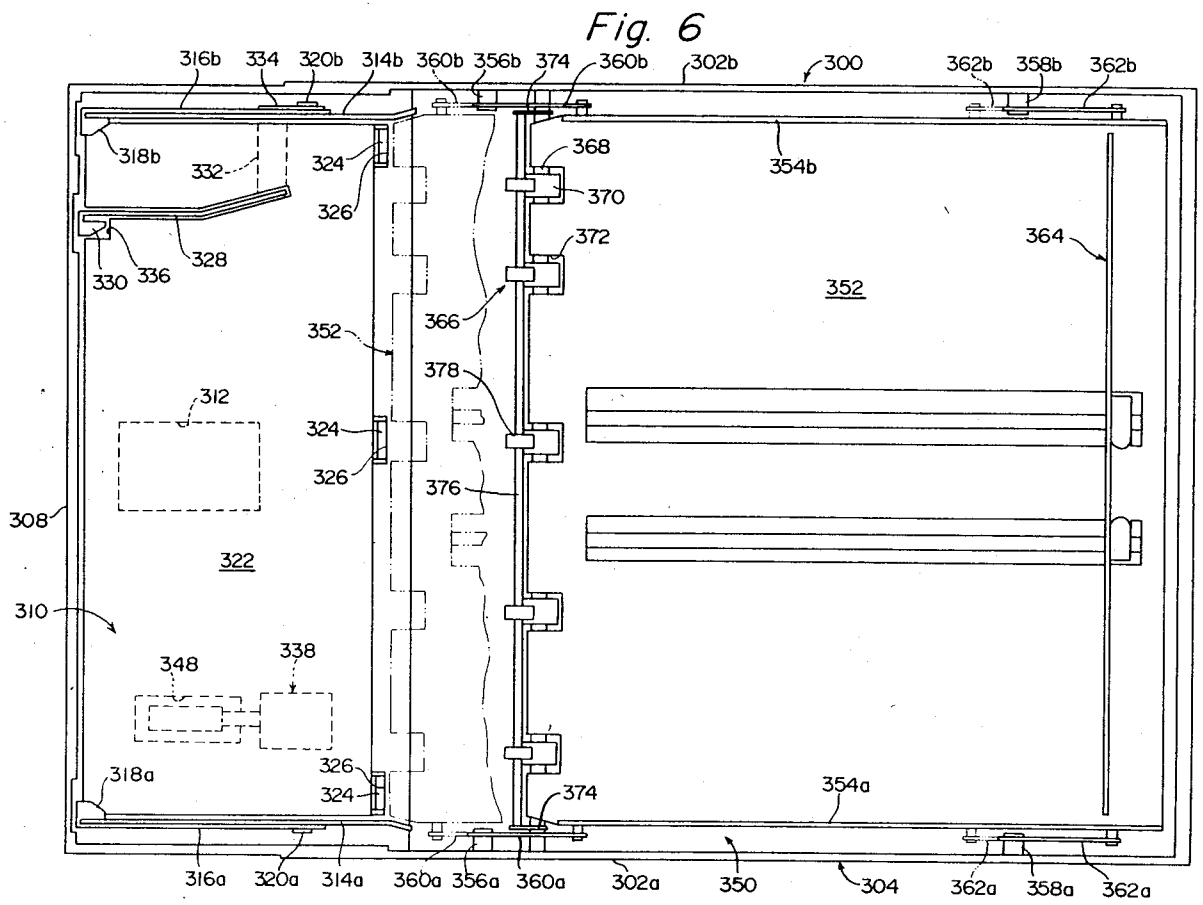
FIG. 6 is a top plan view of the assembly shown in FIG. 5.
Figure 7:
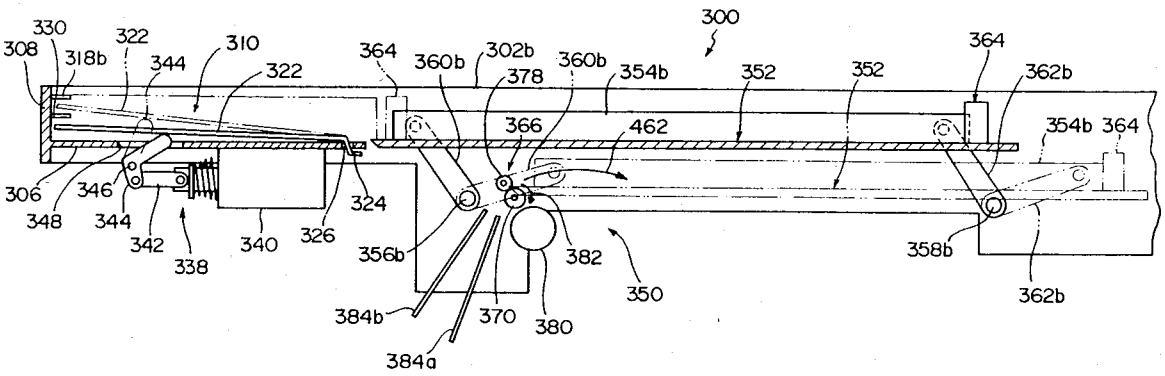
FIG. 7 is a simplified sectional view of the assembly of FIG. 5.

FIGS. 5 to 7 depict a second embodiment of the assembly which can be mounted on the lower paper cassette receiving section **52*b* in the main housing 2 instead of the assembly 66** described above.

The assembly is shown generally at 300, and indludes a supporting frame 304 having side walls **302*a* and 302*b* spaced from each other in the widthwise direction (the up and down direction in FIG. 6) and extending laterally (in the left-right direction in FIG. 6). A bottom wall 306 is fixed across the front portions of the side walls 302*a* and 302*b*, and a front wall 308 is fixed across the front edges of the side walls 302*a* and 302*b*. As a result, a box-like paper receiving receptacle 310 having an open upper surface and an open rear surface is defined by the front portion of the side walls 302*a* and 302*b*, the bottom wall 306 and the front wall 308. At the central portion of the bottom wall in the widthwise direction is formed an opening 312 (FIG. 6) through which the push-up means 54*b* (FIG. 1) disposed in the lower paper cassette receiving section 52*b* in the main housing 2 can extend. As shown in FIG. 6, side edge restricting plates 314*a* and 314*b* are fixed to the bottom wall 306 slightly inwardly of the front portions of the side walls 302*a* and 302*b*. Outwardly of the side edge restricting plates 314*a* and 314*b* are disposed plate-like members 316*a* and 316*b*. Separating claws 318*a* and 318*b* projecting inwardly in the widthwise direction beyond the side edge restricting plates 314*a* and 314*b* are formed as an integral unit on the front end and upper end of the plate-like members 316*a* and 316*b* respectively. The rear end portion of the plate-like members 316*a* and 316*b* are connected pivotably to the side edge restricting plates 314*a* and 314*b* respectively by pins 320*a* and 320*b*, and the plate-like members 316*a* and 316*b* can pivot freely over some angular range (the pivoting of the plate-like members 316*a* and 316*b* is restricted by the contacting of suitable contacting portions (not shown) defined in the plate-like members 316*a* and 316*b* with suitable portions to be contacted (not shown) defined in the side edge restricting plates 314*a* and 314*b*). Accordingly, the separating claws 318*a* and 318*b* can freely move up and down over some range. A carrier plate 322 is disposed between the side edge restricting plates 314*a* and 314*b*. As shown in FIGS. 6 and 7, a plurality of bent portions 324 extending downwardly and then rearwardly and spaced from each other in the widthwise direction are formed in the rear end of the carrier plate 322. Corresponding to them, a plurality of openings 326 spaced from each other in the widthwise direction are formed in the bottom wall 306. By inserting the bent portions 324 into the openings 326, the rear end of the carrier plate 322 is pivotably connected to the bottom wall 306**.

The above-described structure of the paper receiving receptacle 310 in the assembly 300 is substantially the same as a known copying paper case in an ordinary paper cassette. The following improvement, however, has been made in the paper receiving receptacle 310 in the assembly 300 so that it can be used for two types of paper sheets having different widthwise sizes. With reference to FIGS. 6 and 7, in the copying paper receiving receptacle 310, an additional side edge restricting plate 328 is disposed inwardly of the side edge restricting member **314*b* in the widthwise direction by a predetermined distance. An additional separating claw 330 is formed as a unit at the front end and upper end of the additional side edge restricting plate 328. The front portion of the additional side edge restricting plate 328 extends substantially parallel to the side edge restricting plate 314*b*, but its rear portion extends reawardly and inclined slightly outwardly in the widthwise direction. To the lower edge of the rear end portion of the additional side edge restricting plate 328 is fixed a linking member 332 extending from there outwardly in the widthwise direction. The linking member 332 extends through openings (not shown) formed in the side edge restricting plate 314*b* and the plate-like member 316*b*, and a lever 334 is fixed to the outside end of the linking member 332. The rear end portion of the lever 334 is pivotably connected to the side edge restricting plate 314*b* by the pin 320*b*. Thus, the additional side edge restricting plate 328 can freely pivot over some angular range (the pivoting of the additional side edge restricting plate 328 is restricted by the contacting of a suitable contacting portion (not shown) defined in the additional side edge restricting plate 328 with a suitable portion to be contacted (not shown) defined in the side edge restricting plate 314*b* and/or the upper surface of the bottom wall 306). Hence, the additional separating claw 330 can move up and down over some range. The lowermost position of the additional separating claw 330 is the position shown in FIG. 7 and is set slightly lower than the lowest position of the claws 318*a* and 318*b*, i.e. the position shown in FIG. 7**.

As shown clearly in FIG. 6, a cut 336 corresponding to the additional side edge restricting plate 328 and the additional separating claw 330 is formed in the carrier plate 322 and an elevating means 338 is provided for selectively elevating the carrier plate 322 from a lowered position shown by a solid line in FIG. 7 to an elevated position shown by a two-dot chain line in FIG. 7. As shown in FIG. 7, the elevating means 338 includes an electromagnetic solenoid 340 fixed to the lower surface of the bottom wall 306, a linking lever 342 and a swivel lever 344. The swivel lever 344 is mounted pivotably about a pin 346 as a center, and the upper end of the swivel lever 344 projects upwardly through an opening 348 (see FIG. 6 also) formed in the bottom wall 306. One end of the linking lever 342 is pivotably linked to the iron core of the electromagnetic solenoid and the other end is pivotably linked to the lower end of the swivel lever 344.

When a copying paper having a relatively large width corresponding to the width between the side edge restricting plates **314*a* and 314*b* is to be carried into the paper receiving receptacle 310 improved as above, the electromagnetic solenoid 340 is energized and the carrier plate 322 is elevated to the elevated position shown by a two-dot chain line in FIG. 7. As a result, as can be easily understood from FIG. 7, the additional side edge restricting plate 328 and the additional separating claw 330 are located below (or on nearly the same level as) the upper surface of the carrier plate 322. Accordingly, the copying paper of a relatively large width which is advanced over the carrier plate 322 in the manner described below and carried into the paper receiving receptacle 310 is not interfered with by the additional side edge restricting plate 328 and the additional separating claw 330. On the other hand, when a copying paper of a relatively small width corresponding to the width between the side edge restricting plate 314***a* and the additional side edge restricting plate 328 is to be carried into the paper receiving receptacle 310, the electromagnetic solenoid 340 is deenergized, and the carrier plate 322 is held at the lowered position shown by a solid line in FIG. 7. As a result, as can be easily understood from FIG. 7, the additional side edge restricting plate 328 and the additional separating claw 330 project upwardly beyond the upper surface of the carrier plate 322 through the recess 336 formed in the carrier plate 322. When in this condition, the copying paper of a relatively small width is advanced over the carrier plate 322, one side edge of the copying paper is guided by the additional side edge restricting plate 328 and carried as desired into the paper receiving receptacle 310. When the copying paper carried into the paper receiving receptacle 310 is to be delivered from it, the push-up means 54*b* disposed in the lower paper cassette receiving section 52*b* of the main housing 2 is held at the operating position shown by a solid line in FIG. 1, and therefore, the carrier plate 322, the copying paper on it, and the separating claws 318*a* and 318*b* (or the separating claw 318*a* and the additional separating claw 330) are elastically biased upwardly to a predetermined position to push the copying paper against the delivery roller 56*b* (see FIG. 1 also).

In the above-described paper receiving receptacle 310, the carrier plate 322 is elevated to the elevated position when the copying paper having a relatively large width is carried into it. If desired, however, it is possible instead to lower the additional side edge restricting plate 328 and the additional separating claw 330 below the position shown in FIG. 7 and thus bring them to a position below (or to nearly the same level as) the upper surface of the carrier plate 322. The above improvement in the paper receiving receptacle 310 in the assembly 300 may also be applied to the paper receiving receptacle 180 in the assembly 66 illustrated in FIG. 3.

Further with reference to FIGS. 5 to 7, a reverse carrying means shown generally at 350 is provide in the assembly 300 rearwardly of the paper receiving receptacle 310. The reverse carrying means 350 includes a moving plate 352 to be selectively held at a receiving position shown by a two-dot chain line in FIGS. 5 and 7 and a solid line in FIG. 6 and feed position shown by a solid line in FIGS. 5 and 7 and a two-dot chain line in FIG. 6. Upstanding side walls 354*a* and 354*b* are formed on both side edges of the moving plate 352. To the inside surfaces of the side walls 302*a* and 302*b* of the supporting frame 304 are fixed short shafts 356*a* and 358*a* and 356*b* and 358*b* respectively spaced from each other in the front-rear direction (the left-right direction in FIGS. 6 and 7). Linking levers 360*a* and 362*a* and 360*b* and 362*b* are pivotably linked at their one end to the short shafts 356*a* and 358*a* and 356*b* and 358*b*, respectively, and pivotably linked at their other end to the upstanding side walls 354*a* and 354*b* of the moving plate. It will be easily understood by reference to FIG. 7 that the moving plate 352 is caused to pivot between the receiving position and the feed position about the short shafts, 356*a* and 358*a* and 356*a* and 358*b* as a center of pivoting (means for pivoting) the moving plate 352 will be described hereinafter). On the moving plate 352 is provided a feed means 364 formed of a plate-like member extending in the widthwise direction (the up and down direction in FIG. 6). The feed means 364 can move freely in the front-rear direction over the moving plate 352 (means for moving the feed means 364 will be described hereinafter).

A conveying roller unit 366 is provided between the side walls 302*a* and 302*b* in relation to the front edge portion of the moving plate 352 held at this receiving position. As shown in FIG. 6, a shaft 368 is rotatably mounted across the side walls 302*a* and 302*b*, and a plurality of rollers 370 spaced from each other in the widthwise direction are fixed to the shaft 368. As shown in FIGS. 5 and 6, a plurality of cuts 372 spaced from each other in the widthwise direction are formed in the front edge portion of the moving plate 352, and when the moving plate is held at the receiving position, the rollers 370 are positioned partly within the cuts 372. One end of a bracket 374 is pivotably mounted on both end portions of the shaft 368, and a shaft 376 is rotatably mounted across the free ends of the brackets 374, and a plurality of rollers 378 spaced from each other in the widthwise direction are fixed to the shaft 376. The rollers 378 are brought into contact with the rollers 370 by the weights of the shaft 376 and the rollers 378. A driving source 380 (FIG. 7) which may be an electric motor is fixed to the inside surface of the side wall 302*b*, and the shaft 368 is drivingly connected to the driving source 380. As a result, the conveying roller unit 366 is rotated in the direction shown by an arrow 382 (FIG. 7) by the driving source 380. Guide plates 384*a* and 384*b* whose upper ends are close to the conveying roller unit 366 are fixed across the side walls 302*a* and 302*b*.

With reference to FIG. 5, to the rear end portions of the side walls 302*a* and 302*b* are fixed respectively suspending walls 386*a* and 386*b* extending downwardly therefrom. A horizontal supporting wall 388 is fixed across the lower ends of the suspending walls 386*a* and 386*b*. To the supporting wall 388 are fixed a driving source 390 which may be a reversible electric motor and a driving connection controlling means 392 constructed of an electromagnetic solenoid. Furthermore, three upstanding plates 394, 396 and 398 spaced in the widthwise direction between the driving source 390 and the driving connection controlling means 392 are fixed to the supporting wall 388. The output shaft 400 of the driving source 390 extends through the upstanding plate 394, and a gear 402 is fixed to the forward end of the output shaft 400. Shafts 404, 406 and 408 are rotatably mounted across the upstanding plates 394 and 396. A gear 410 is fixed to the shaft 404, a gear 412 is fixed to the shaft 406, and a gear 414 is fixed to the shaft 408. The gear 410 is in mesh with the gear 402, and the gear 414 is in mesh with the gear 412. Shafts 418 and 420 are rotatably mounted across the upstanding plates 396 and 398. A gear 422 is fixed to the shaft 418, and gears 424 and 426 are fixed to the shaft 420. The gear 426 is in mesh with the gear 422. A protrusion 428 is formed in the gear 422. A shaft 430 is rotatably and axially movably mounted on the upstanding plates 394, 396 and 398 and extends through the upstanding plates. To the shaft 430 are fixed a gear 432 located between the upstanding plates 394 and 396 and a gear 434 located between the upstanding plates 396 and 398. A nearly L-shaped member 436 is fixed to the iron core of the electromagnetic solenoid constituting the driving connection controlling means 392, and one end of the shaft 430 is linked to the member 436 so that it is freely rotatable but cannot move relatively in the axial direction. When the driving connection controlling means 392 is in the deenergized state, the gears 432 and 434 fixed to the shaft 430 are located at the position shown by a solid line, the gear 432 is in mesh with the gear 410, and the gear 434 is in mesh with the gear 426. Accordingly, the driving source 390 is drivingly connected to the gear 422 via the gears 402, 410, 432, 426 and 424. When the driving connection controlling means 392 is energized, the gears 432 and 434 fixed to the shaft 430 are moved to the positions shown by two-dot chain lines. Consequently, the gear 432 is brought into mesh not only with the gear 410 but also with the gear 412. Accordingly, the driving source 390 is drivingly connected to the shaft 408 via the gears 402, 410, 432, 412 and 414. On the other hand, the gear 434 is detached from the gear 426 and the gear 422 is cut off from the driving source 390.

A supporting bracket 438 is fixed to the under surface of the rear end portion of the moving plate 352, and a shaft 440 is rotatably mounted on the bracket 438. The free end of the protrusion 428 formed in the gear 422 is pivotably connected to the shaft 440. When the protrusion 428 is held at the position shown by a solid line by the rotation of the gear 422 in the direction shown by an arrow 442, the moving plate 352 is held at the feed position shown by a solid line. When the protrusion 428 is held at the position shown by a two-dot chain line by the rotation of the gear 422 in the direction shown by an arrow 444, the moving plate 352 is held at the receiving position shown by a two-dot chain line.

Pulleys 446*a* and 446*b* are fixed to both ends of the shaft 440 mounted rotatably on the supporting bracket 438. An endless belt 448 is wrapped about the shaft 440 and the shaft 408. A supporting bracket similar to the supporting bracket 438 is fixed to the under surface of the front end portion of the moving plate 352, and a shaft similar to the shaft 440 is rotatably mounted on such a bracket. Pulleys similar to the pulleys 446*a* and 446*b* are fixed to both ends of such a shaft. An endless belt 450*a* is wrapped about the pulley 446*a* and the corresponding pulley, and an endless belt 450*b* is wrapped about the pulley 446*b* and the corresponding pulley. Two elongated slots 452*a* and 452*b* extending in the front-rear direction are formed in the moving plate 352, and the upper running sections of the endless belts 450*a* and 450*b* are exposed through the slots 452*a* and 452*b* respectively. On the other hand, linking pieces 454*a* and 454*b* are fixed to the lower end of the central part of the rear surface of the feed means 364, and connected to the endless belts 450*a* and 450*b* by pins 456*a* and 456*b*. Thus, when the endless belts 450*a* and 450*b* are driven in the direction shown by an arrow 458, the feed means 364 is advanced over the moving plate 352, and when the endless belts 450*a* and 450*b* are driven in the direction shown by an arrow 460, the feed means 364 is moved backward on the moving plate 352.

The operation of the reverse carrying means 350 described hereinabove with reference to FIG. 7 is described below. When the assembly 300 is mounted instead of the assembly 66 on the lower paper cassette receiving section 52*b* of the main housing 2 illustrated in FIG. 1, the lower ends of the guide plates 384*a* and 384*b* are located opposite to the return roller unit 156. Accordingly, a copying paper discharged from the return roller unit 156 is sent to the conveying roller unit 366 rotating in the direction of arrow 382, between the guide plates 384*a* and 384*b*. At this time, the moving plate 352 is held at the receiving position spaced rearwardly and downwardly of the paper receiving receptacle 310 as shown by a two-dot chain line in FIG. 7, and the feed means 364 on the moving plate 352 is positioned at the rear end portion of the moving plate 352. Therefore, the copying paper discharged from the conveying roller unit 366 is moved as shown by the arrow 462 and carried onto the moving plate 352. When one or a plurality of copying paper sheets have been carried onto the moving plate 352, the driving source 390 is energized for a predetermined period of time and rotated in a normal direction. Consequently, the moving plate 352 is held at the feed position adjacent the paper receiving receptacle 310 as shown by a solid line in FIG. 7. Thereafter, the driving connection controlling means 392 is energized and the driving source 390 is energized for a predetermined period of time and rotated in a normal direction. Consequently, the feed means 364 on the moving plate 352 is advanced from the rear end portion to the front end portion of the moving plate 352. Thus, the copying paper on the moving plate 352 is forced forwardly by the means 364 and carried into the paper receiving receptacle 310 from the moving plate 352. Then, the driving source 390 is energized for a predetermined period of time and rotated in the reverse direction. As a result, the feed means 364 on the moving plate 352 is moved backward from the front end portion to the rear end portion of the moving plate 352. The driving connection controlling means 392 is deenergized. Then, the driving source 390 is energized for a predetermined period of time and rotated reversely whereby the moving plate 352 is returned to the receiving position shown by a two-dot chain line in FIG. 7.

Figure 8:
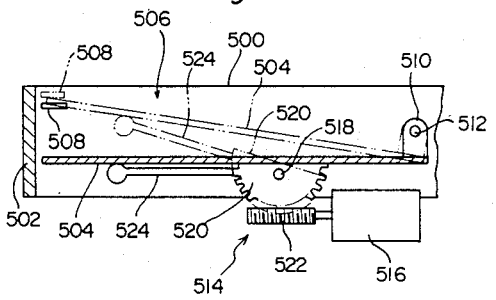
FIG. 8 is a simplified sectional view showing a modified example of the copying paper receiving receptacle shown in FIG. 1.

The push-up means 54*b* adapted to be selectively held at the operating position shown by a solid line and the non-operating position shown by a two-dot chain line is disposed in the lower paper cassette receiving section 52*b* located in the main housing 2 illustrated in FIG. 1. When the assembly 66 (FIG. 3) or the assembly 300 (FIGS. 5 to 7) is mounted on the lower paper cassette receiving section 52*b* and the push-up means 54*b* is held at the operating position shown by a solid line, the push-up means 54*b* acts on the carrier plate 188 or 322 of the paper receiving receptacle 180 or 310 in the assembly 66 or 300, and consequently, the copying paper on the carrier plate 188 or 322 is pushed against the delivery roller 56*b*. A copying paper cassette receiving section of the type having no push-up means also finds practical use as a paper cassette receiving section to be formed in the main housing (in which case means for elastically biasing the carrier plate upwardly is disposed in the paper cassette case). FIG. 8 shows a modified example of the copying paper receiving receptacle which can be used instead of the paper receiving receptacle 180 or 310 in the assembly 66 or 300 when the paper cassette receiving section formed in the main housing 2 has no push-up means.

With reference to FIG. 8, a front wall 502 is fixed across the front end edges of a pair of side walls 500 (only one of which is shown in FIG. 8) of the supporting frame in the assembly, and a carrier plate 504 is provided between the front end portions of the pair of side walls 500. Thus, a box-like paper receiving receptacle 506 having an open top surface and an open rear surface (including no bottom wall) is defined by the pair of side walls 500, the front wall 502 and the carrier plate 504. A plate-like member having formed as an integral unit a separating claw 508 at its front end and upper end is disposed inwardly of each of the front portions of the pair of side walls 500. The plate-like members may be substantially the same as the plate-like members 184*a* and 184*b* shown in FIG. 3 or the plate-like members 316*a* and 316*b* shown in FIG. 6. In FIG. 8, only the separating claw 508 is shown for clear illustration. The separating claw 508 can freely move up and down between the position shown by a solid line and the position shown by a two-dot chain line.

Linking pieces 510 extending upwardly are formed respectively at both side edges of the rear end portion of the carrier plate 504, and are pivotably connected to the pair of side walls 500 respectively by pins 512. Thus, the carrier plate 504 is mounted pivotably about the pin 512 as a center. A pivoting means shown generally at 514 is provided below the carrier plate 504. The pivoting means 514 includes a driving source 516 (which may be a reversible electric motor) fixed to the side wall 500 through a suitable supporting bracket (not shown) and a semicircular worm gear 520 rotatably mounted on the side wall 500 by a pin 518. A worm 522 in mesh with the worm gear 520 is fixed to the output shaft of the driving source 516. To the worm gear 520 is fixed a push-up lever 524 preferably formed of a plate spring.

When a copying paper is carried into the paper receiving receptacle 506 described above, the worm gear 520 is held at the angular position shown by a solid line. At this time, the carrier plate 504 is positioned substantially horizontally as shown by a solid line as a result of its under surface abutting against the free end of the push-up lever 524. When the copying paper is delivered from the paper receiving receptacle 506, the worm gear 520 is rotated to the angular position shown by a two-dot chain line. Consequently as shown by a two-dot chain line, the carrier plate 504 is pivoted by the push-up lever 524 in a direction in which the front end portion of the plate 504 rises. Thus, the copying paper on the carrier plate 504 is pushed elastically against the delivery roller 56*b* provided in the lower cassette receiving section 52*b* of the main housing 2 (see FIG. 1 also).

Figure 9:
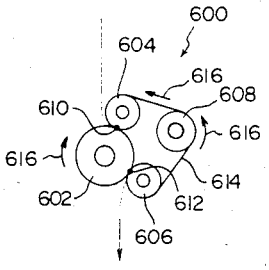
FIG. 9 is a simplified sectional view showing a curl correcting means.

FIG. 9 shows one example of a curl correcting means which can be disposed upstream or downstream of the conveying direction controlling roller unit 128 shown in FIG. 1, or instead of the conveying direction controlling roller unit 128. As described with reference to FIG. 1, when the paper swerving means 96 is at its operating position shown by a two-dot chain line in FIG. 1, the copying paper discharged from the conveying roller unit 80 abuts against the swerving surface 106 of the paper swerving means 96, and is swerved downwardly along the swerving surface 106. When the copying paper is so swerved, curl in a specific direction tends to form in the copying paper. When the copying paper having the so formed curl is sent directly to the copying paper returning means 142, the conveying of the paper might not be carried out in the required manner. A curl correcting means 600 illustrated in FIG. 9 corrects the curl by forcibly bending the paper in a direction opposite to the curl formed in the paper owing to the swerving of the paper.

The curl correcting means 600 illustrated in FIG. 9 includes a main roller 602, auxiliary rollers 604 and 606 and a driven roller 608. These rollers 602, 604, 606 and 608 are mounted rotatably. The driven roller 608 is drivingly connected to a driving source (not shown) which may be an electric motor. The auxiliary rollers 604 and 606 are pressed against the main roller 602 at two positions 610 and 612 spaced from each other in the circumferential direction of the main roller 602. An endless belt 614 is wrapped about the auxiliary rollers 604 and 606 and the driven roller 608. The endless belt 614 extends along the peripheral surface of the main roller 602 between the positions 610 and 612. When the driven roller 608 is rotated in the direction shown by an arrow 616 by a driving source (not shown), the endless belt 614 and the main roller 602 are also rotated in the direction shown by arrow 616. When in this state the copying paper swerved downwardly by the paper swerving means 96 (FIG. 1) is conducted to the position 610, it is further conveyed downwardly between the endless belt 614 and the main roller 602 as shown by a two-dot chain line. By the passing of the paper between the endless belt 614 and the main roller 602, the paper is bent in a direction opposite to the direction of the curl formed by the downward swerving of the paper by the paper swerving means 96 (FIG. 1) and consequently, the curl is corrected.

Figure 10:
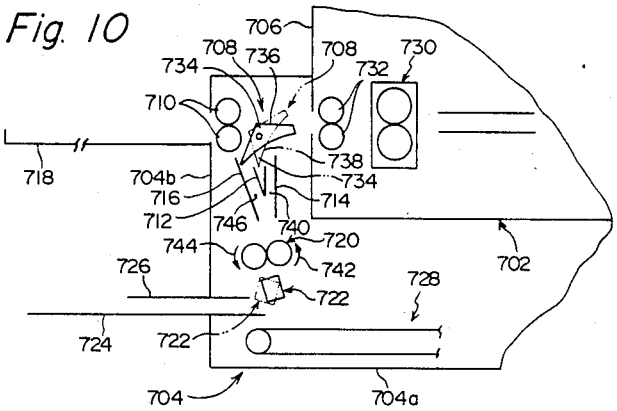
FIG. 10 is a simplified partial sectional view showing a modified example of the relation between the main housing and the subsidiary housing shown in FIG. 1.

FIG. 10 shows a modified example of the relation between the main housing and the subsidiary housing. In this modified example, a subsidiary housing 704 is of a nearly L-shaped as a whole, and has a first portion 704*a* located beneath a main housing 702 and a second portion 704*b* located adjacent the left side wall 706 of the main housing 702. The left end portion of the first portion 704*a* projects to the left beyond the left side wall 706 of the main housing 702. A copying paper swerving means 708, a discharge roller unit 710 and guide members 712, 714 and 716 are provided not in the main housing 702 but in the second portion 704*b* of the subsidiary housing 704. A copying paper receiving means 718 is mounted not in the main housing 702 but on the second portion 704*b* of the subsidiary housing 704. A conveying direction controlling roller unit 720, a movable copying paper guiding means 722, guide plates 724 and 726 and the left end portion of a copying paper returning means 728 are disposed in the left end portion of the first portion 704*a* of the subsidiary housing 704 located below the second portion 704*b* of the subsidiary housing 704.

When the paper swerving means 708 in the modified example shown in FIG. 10 is held at tis non-operating position shown by a solid line, a copying paper discharged from the main housing 702 through a fixing means 730 and a conveying roller unit 732 in the main housing 702 is introduced into the second portion 704*b* of the subsidiary housing 704, passed over the guiding surfaces 736 of swerving members 734 in the paper swerving means 708, and discharged into the paper receiving means 718 by the action of the discharge roller unit 710. When the paper swerving means 708 is held at its operating position shown by a two-dot chain line, the copying paper which has been discharged from the main housing 702 and introduced into the second portion 704*b* of the subsidiary housing 704 is swerved downwardly by the swerving surfaces 738 of the swerving members 734 in the paper swerving means 718. The copying paper is sent to the conveying direction controlling roller unit 720 rotated in a normal direction, i.e. in the direction shown by an arrow 742. Then, the copying paper is sent to the paper returning means 728 through the movable paper guiding means 722 held at the first position shown by a solid line. Alternatively, the copying paper is sent to the guide plates 724 and 726 through the movable paper guiding means 722 held at the second position shown by a two-dot chain line and thereafter the conveying direction controlling roller unit 720 is rotated in a reverse direction, i.e. in the direction of an arrow 744, whereby the copying paper is sent to the discharge roller unit 710 through a return guide passage 746 and discharged into the paper receiving means 718.

It will be easily understood that in the modified example illustrated in FIG. 10, the structure of the inside of the main housing 702 may be substantially the same as a conventional electrostatic copying apparatus for producing an image only on one surface of a copying paper. Accordingly, if the subsidiary housing 704 is detached from the main housing 702, the apparatus can be used as an ordinary electrostatic copying apparatus for producing an image only on one surface of the copying paper (in which case the paper receiving means 718 can be mounted on the left side wall 706 of the main housing 702). In other words, if the subsidiary housing 704 is combined with a conventional electrostatic copying apparatus for producing an image only on one surface of a copying paper and the assembly 66 shown in FIG. 3 or the assembly 300 shown in FIGS. 5 to 7 is mounted on the lower paper cassette receiving section of the conventional electrostatic apparatus (see FIG. 1), an image can be produced, as required, on both surfaces of the copying paper.

Figure 11:
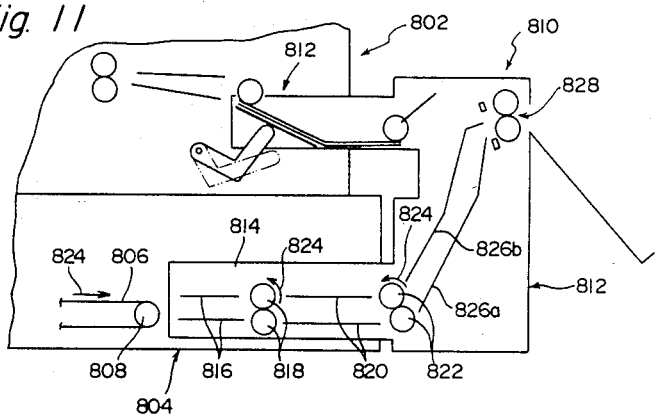
FIG. 11 is a simplified partial sectional view showing a modified example of the relation between the subsidiary housing and the assembly shown in FIG. 1.

FIG. 11 illustrates a modified example of the relation between the subsidiary housing and the assembly. The structure of the inside of a subsidiary housing 804 shown in FIG. 11 differs in the following respect from that of the inside of the subsidiary housing 122 shown in FIGS. 1 and 2. A pulley 808 about which an endless belt 806 is wrapped is disposed at a position spaced to the left a predetermined distance from the right end of the subsidiary housing 804, and the return roller pair is not provided. An assembly 810 shown in FIG. 11 differs in the following respect from the assembly 66 shown in FIGS. 1 to 3. A pair of side walls 812 (only one of which is shown in FIG. 11) of the assembly 810 have an additional portion 814 which is positioned in the left end portion of the subsidiary housing 804 when the assembly 810 is mounted on a lower paper cassette receiving section 812 provided in the main housing 802. Between the additional portions 814 of the pair of side walls 814 are disposed a pair of guide plates 816, a return roller unit 818, a pair of guide plates 820 and a return roller unit 822 from left to right in this sequence. The return roller units 818 and 822 are adapted to be rotated in the direction shown by an arrow 824 by a driving source (not shown) which may be an electric motor.

In the modified example shown in FIG. 11, a copying paper from the endless belt 806 driven in the direction of arrow 824 is sent between guide plates **826*a* and 826*b* through the pair of guide plates 816, the return roller unit 818, the pair of guide plates 820 and the return roller unit 822, and returned to a carrying roller unit 828. Otherwise, the structure and operation of the modified example shown in FIG. 11 may be the same as those of the electrostatic copying apparatus shown in FIG. 1**.

Figure 12:
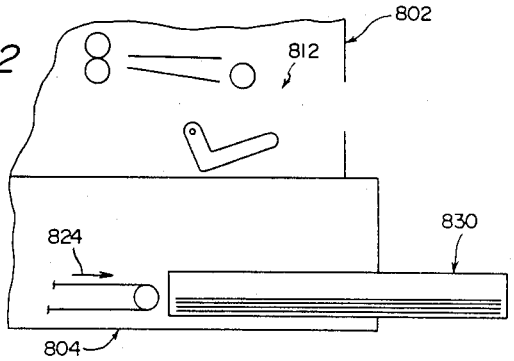
FIG. 12 is a simplified partial sectional view showing that state of the electrostatic copying apparatus illustrated in FIG. 1 in which the assembly has been detached and an additional copying paper receiving receptacle has been mounted on the subsidiary housing.

In the modified example illustrated in FIG. 11, the following semi-manual or semi-automatic operation may also be performed when an image is to be produced on both surfaces of the copying paper. As shown in FIG. 12, the assembly 810 is detached from the lower paper cassette receiving section 812 formed in the main housing 802, and an additional copying paper receiving receptacle 830 is inserted into the right end portion of the subsidiary housing 804. The additional paper receiving receptacle 830 may be of any suitable type capable of receiving the paper from the endless belt 806 at its front surface. As a result, the copying paper returned by the endless belt 806 is carried directly into the additional paper receiving receptacle 830 while its leading edge is located at the rear end of the additional paper receiving receptacle 830 and its trailing end is located at the front end of the additional paper receiving receptacle 830. When one or a plurality of copying paper sheets are carried into the additional paper receiving receptacle 830, the additional paper receiving receptacle 830 is detached from the subsidiary housing 804 and the additional paper receiving receptacle 830 is mounted on the lower copying paper cassette receiving section 812 of the main housing 802 so that copying paper sheets can be delivered from the additional paper receiving receptacle. Such a semi-manual or semi-automatic operation is especially useful when the length of the copying paper in the conveying direction is considerably large and it is impossible or difficult to handle the copying paper automatically by using the assembly 810.

While the embodiments consturcted in accordance with this invention have been described in detail with reference to the accompanying drawings, it should be understood that various changes and modifications are possible without departing from the scope of the invention.

What is claimed is:

1. An electrostatic copying apparatus comprising:

a main housing;

an electrostatic photosensitive member disposed within the main housing and adapted to be moved through an endless path;

means defining a latent electrostatic image-forming zone, a developing zone and a transfer zone successively in the moving direction of the photosensitive member along the endless path;

means for forming a latent electrostatic image on the photosensitive member in the latent electrostatic image-forming zone;

developing means in the developing zone for developing the latent electrostatic image on the photosensitive member to a toner image;

copying paper feeding means;

copying paper receiving means;

means defining a copying paper conveying passage extending from the paper feeding means to the paper receiving means via the transfer zone;

copying paper conveying means for conveying a copying paper through the copying paper conveying passage;

transfer means for transferring the toner image on the photosensitive member to copying paper in the transfer zone;

fixing means for fixing the toner image on the copying paper, said fixing means being disposed at that position of the paper conveying passage which is downstream of the transfer zone;

copying paper swerving means disposed within the paper conveying passage and between the fixing means and the paper receiving means and adapted to be selectively held at a non-operating position at which the swerving means permits copying paper to be discharged into the paper receiving means through the paper conveying passage and an operating position at which the swerving means swerves the copying paper from the conveying passage;

paper re-feeding means for feeding the received copying paper into the paper conveying passage at a position upstream of the transfer zone;

copying paper returning means for returning swerved copying paper to the paper re-feeding means while the front and back surfaces of the paper are reversed, said swerved copying paper having been swerved from the paper conveying passage by the paper swerving means held at the operation position; and a conveying direction controlling roller unit disposed between the paper swerving means and the paper returning means and adapted to be rotated selectively in a normal direction and a reverse direction, the copying paper, when swerved from the paper conveying passage by the copying paper swerving means being held at its operating position, is conveyed while being nipped by the conveying direction controlling roller unit, and when the conveying direction controlling roller unit continues to be rotated in a normal direction until the trailing end of the copying paper passes the conveying direction controlling roller unit, the copying paper is caused to make a returning movement by the action of the paper re-feeding means, and when the rotating of the conveying direction controlling roller unit is switched to a reverse direction from the normal direction, the copying paper with its front and back surfaces and its leading and trailing ends reversed is returned to the copying paper conveying passage at a position downstream of the paper swerving means and is discharged into the paper receiving means.

2. The electrostatic copying apparatus of claim 1 which further comprises a movable copying paper guiding means disposed between the conveying direction controlling roller unit and the copying paper returning means and adapted to be selectively held at a first position at which it conducts to the paper returning means the copying paper conveyed by the conveying direction controlling roller unit rotating in a normal direction and a second position at which it moves the copying paper conveyed by the conveying direction controlling roller unit rotating in a normal direction away from the paper returning means.

3. The electrostatic copying apparatus of claim 1 wherein the conveying direction controlling roller unit is rotated in a reverse direction at a higher speed than it is in a normal direction.

4. The electrostatic copying apparatus of claim 3 wherein a discharge roller unit is disposed at that part of the paper conveying passage which is between the paper swerving means and the copying paper receiving means, and when the conveying direction controlling roller unit is reversed in rotating direction, the copying paper is returned to the paper conveying passage between the paper swerving means and the discharge roller unit, and when the conveying direction controlling roller unit is in reverse rotation, the discharge roller unit is rotated at a higher speed than in a usual case corresponding to the reverse rotation speed of the conveying direction controlling roller unit.

5. The electrostatic copying apparatus of claim 1 wherein when the rotation of the conveying direction controlling roller unit is switched from its normal direction to its reverse direction and the copying paper is discharged into the copying paper receiving means, the conveying of the next copying paper through the paper conveying passage is delayed by more than a predetermined period of time.

6. The electrostatic copying apparatus of claim 5 wherein the delivery of the copying paper from either the paper feeding means or the paper re-feeding means is delayed by more than a predetermined period of time, whereby the conveying of the next copying paper through the paper conveying passage is delayed by more than a predetermined period of time.

7. An electrostatic copying apparatus comprising:

a main housing;

an electrostatic photosensitive member disposed within the main housing and adapted to be moved through an endless path;

means defining a latent electrostatic image-forming zone, a developing zone and a transfer zone successively in the moving direction of the photosensitive member along the endless path;

means for forming a latent electrostatic image on the photosensitive member in the latent electrostatic image-forming zone;

developing means in the developing zone for developing the latent electrostatic image on the photosensitive member to a toner image;

copying paper feeding means;

copying paper receiving means;

means defining a copying paper conveying passage extending from the paper feeding means to the paper receiving means via the transfer zone;

copying paper conveying means for conveying a copying paper through the copying paper conveying passage;

transfer means for transferring the toner image on the photosensitive member to copying paper in the transfer zone;

fixing means for fixing the toner image on the copying paper, said fixing means being disposed at that position of the paper conveying passage which is downstream of the transfer zone;

copying paper swerving means disposed within the paper conveying passage and between the fixing means and the paper receiving means and adapted to be selectively held at a non-operating position at which the swerving means permits copying paper to be discharged into the paper receiving means through the paper conveying passage and an operating position at which the swerving means swerves the copying paper from the conveying passage;

a paper re-feeding means for feeding the received copying paper into the paper conveying passage at a position upstream of the transfer zone;

copying paper returning means for returning swerved copying paper to the paper re-feeding means while the front and back surfaces of the paper are reversed, said swerved copying paper having been swerved from the paper conveying passage by the paper swerving means held at the operation position; and curl correcting means disposed between the paper swerving means and the paper returning means, said curl correcting means being adapted to bend the copying paper in a direction opposite to the direction of the curl formed in the copying paper owing to the swerving of the paper by the paper swerving means held at its operating position, thereby correcting the curl.

8. The electrostatic copying apparatus of claim 7 wherein the curl correcting means includes a main roller, two auxiliary rollers spaced circumferentially from the main roller and cooperating with the main roller and an endless belt wrapped about the two auxiliary rollers and extending along the circumferential surface of the main roller between the two auxiliary rollers, and the copying paper is moved between the main roller and the endless belt.

9. An electrostatic copying apparatus comprising:

a main housing;

an electrostatic photosensitive member disposed within the main housing and adapted to be moved through an endless path;

means defining a latent electrostatic image-forming zone, a developing zone and a transfer zone successively in the moving direction of the photosensitive member along the endless path;

means for forming a latent electrostatic image on the photosensitive member in the latent electrostatic image-forming zone;

developing means in the developing zone for developing the latent electrostatic image on the photosensitive member to a toner image;

copying paper feeding means;

copying paper receiving means;

means defining a copying paper conveying passage extending from the paper feeding means to the paper receiving means via the transfer zone;

copying paper conveying means for conveying a copying paper through the copying paper conveying passage;

transfer means for transferring the toner image on the photosensitive member to copying paper in the transfer zone;

fixing means for fixing the toner image on the copying paper, said fixing means being disposed at that position of the paper conveying passage which is downstream of the transfer zone;

copying paper swerving means disposed within the paper conveying passage and between the fixing means and the paper receiving means and adapted to be selectively held at a non-operating position at which the swerving means permits copying paper to be discharged into the paper receiving means through the paper conveying passage and an operating position at which the swerving means swerves the copying paper from the conveying passage;

a paper re-feeding means for feeding the received copying paper into the paper conveying passage at a position upstream of the transfer zone;

copying paper returning means for returning swerved copying paper to the paper re-feeding means while the front and back surfaces of the paper are reversed, said swerved copying paper having been swerved from the paper conveying passage by the paper swerving means held at the operation position;

a carrying roller unit disposed rearwardly of the paper re-feeding means and adapted to be rotated selectively in a normal direction and a reverse direction, the copying paper from the paper returning means being nipped by the carrying roller unit rotating in a normal direction and conveyed in a direction away from the paper re-feeding means, and when the rotation of the carrying roller unit is switched from the normal direction to a reverse direction before the trailing end of the copying paper passes through the carrying roller unit, the copying paper is conveyed with its leading and trailing ends reversed and carried into the paper re-feeding means.

10. The electrostatic copying apparatus of claim 9 wherein said apparatus has a supporting frame mounted detachably on the main housing, and the paper re-feeding means includes a paper receiving receptacle formed in the supporting frame.

11. The electrostatic copying apparatus of claim 10 wherein the carrying roller unit is mounted on the supporting frame.

12. The electrostatic copying apparatus of claim 11 wherein said apparatus includes an additional copying paper receiving means mounted on the supporting frame and located rearwardly of the carrying roller unit, and when the carrying roller unit continues to rotate in a normal direction until the trailing end of the copying paper nipped by the carrying roller unit rotating in a normal direction and conveyed in a direction away from the paper re-feeding means passes the carrying roller unit, the copying paper is discharged into the additional copying paper receiving means.

13. The electrostatic copying apparatus of claim 12 wherein said apparatus includes a paper stacked layer detector for detecting the feeding of two or more copying paper sheets in the stacked states and produces an output signal, and when the paper stacked layer detector produces said output signal, the carrying roller unit continues to rotate in a normal direction until the trailing end of the copying paper conveyed in a direction away from the paper re-feeding means while being nipped by the carrying roller unit rotating in a normal direction passes the carrying roller unit, whereby two or more stacked paper sheets are discharged into the additional paper receiving means.

14. The electrostatic copying apparatus of claim 12 wherein said apparatus further includes an interruption copying switch means adapted to be manually operated and produce an output signal when the interruption copying operation is to be performed, and when the interruption copying switch means produces said output signal, the carrying roller unit continues to be rotated in a normal direction until the trailing end of the copying paper conveyed in a direction away from the paper re-feeding means while being nipped by the carrying roller unit rotating in a normal direction passes the carrying roller unit, whereby the copying paper used in the interruption copying operation is discharged into the additional copying paper receiving means.

15. The electrostatic copying apparatus of claim 9 wherein the paper re-feeding means includes a copying paper receiving receptacle comprising a front wall, and the paper receiving receptacle has provided therein an auxiliary advancing means for advancing the copying paper carried thereinto by the carrying roller unit to a position at which its leading edge abuts against the front wall.

16. The electrostatic copying apparatus of claim 15 wherein the auxiliary advancing means includes a pivoting member extending from its pivotably mounted upper end portion forwardly inclinedly and downwardly and a driven roller mounted on its lower end portion, and the driven roller is adapted to be pressed against the upper surface of the copying paper carried into the paper receiving receptacle by the carrying roller unit.

17. The electrostatic copying apparatus of claim 16 wherein the driven roller is pressed against the upper surface of the copying paper by the weights of the pivoting member and the driven roller.

18. An electrostatic copying apparatus comprising:

a main housing;

an electrostatic photosensitive member disposed within the main housing and adapted to be moved through an endless path;

means defining a latent electrostatic image-forming zone, a developing zone and a transfer zone successively in the moving direction of the photosensitive member along the endless path;

means for forming a latent electrostatic image on the photosensitive member in the latent electrostatic image-forming zone;

developing means in the developing zone for developing the latent electrostatic image on the photosensitive member to a toner image;

copying paper feeding means;

copying paper receiving means;

means defining a copying paper conveying passage extending from the paper feeding means to the paper receiving means via the transfer zone;

copying paper conveying means for conveying a copying paper through the copying paper conveying passage;

transfer means for transferring the toner image on the photosensitive member to copying paper in the transfer zone;

fixing means for fixing the toner image on the copying paper, said fixing means being disposed at that position of the paper conveying passage which is downstream of the transfer zone;

copying paper swerving means disposed within the paper conveying passage and between the fixing means and the paper receiving means and adapted to be selectively held at a non-operating position at which the swerving means permits copying paper to be discharged into the paper receiving means through the paper conveying passage and an operating position at which the swerving means swerves the copying paper from the conveying passage;

a paper re-feeding means for feeding the received copying paper into the paper conveying passage at a position upstream of the transfer zone;

copying paper returning means for returning swerved copying paper to the paper re-feeding means while the front and back surfaces of the paper are reversed, said swerved copying paper having been swerved from the paper conveying passage by the paper swerving means held at the operation position; and a supporting frame adapted to be detachably mounted on the main housing, the paper re-feeding means including a paper receiving receptacle formed in the supporting frame.

19. The electrostatic copying apparatus of claim 18 wherein a copying paper cassette receiving section is formed in the main housing, and a copying paper cassette and the supporting frame are selectively mounted on the paper cassette receiving section.

20. The electrostatic copying apparatus of claim 19 wherein the paper receiving receptacle has a bottom wall having an opening formed therein and a paper carrier plate disposed on the bottom wall with its rear end portion being pivotably mounted; said copying paper cassette receiving section has provided therein a push-up means adapted to be selectively held at its operating position at which it projects through said opening and elastically biases the carrier plate in a direction in which its front portion moves upwardly and its non-operating position at which it recedes downwardly of the bottom wall of the paper receiving receptacle, and a delivery roller disposed above the push-up means; when the copying paper is returned to the inside of the paper receiving receptacle, the push-up means is held at its non-operating position; and when the copying paper is delivered from the paper receiving receptacle to the paper conveying passage, the push-up means is held at the operating position, whereby the copying paper on the carrier plate is pressed against the delivery roller by the elastic biasing action of the push-up means, and the copying paper is delivered by the rotation of the delivery roller.

21. The electrostatic copying apparatus of claim 20 wherein the paper receiving receptacle further has main separating claws disposed above both side portions of the front edge of the carrier plate respectively.

22. The electrostatic copying apparatus of claim 21 wherein the paper receiving receptacle has at least one additional separating claw disposed between said main separating claws, said additional separating claw being freely movable at least between its bottom position below the main separating claws to a predetermined higher position;

when a copying paper having a relatively large width corresponding to the width between the main separating claws is to be returned to the paper receiving receptacle, the additional separating claw is positioned on substantially the same level or at a lower position than the upper surface of the carrier plate by either elevating the front portion of the carrier plate or lowering the additional separating claw; and when a copying paper having a relatively small width whose one side edge is positioned correspondingly to the additional separating claw is to be returned to the paper receiving receptacle, the additional separating claw is positioned above the carrier plate by either lowering the front portion of the carrier plate or elevating the additional separating claw.

23. The electrostatic copying apparatus of claim 22 wherein said apparatus further includes an elevating means for elevating the front portion of the carrier plate when it is energized, and when the copying paper having a relatively large width is to be returned to the paper receiving receptacle, the elevating means is energized, and when the copying paper having a relatively small width is to be returned to the paper receiving receptacle, the elevating means is deenergized.

24. The electrostatic copying apparatus of claim 22 wherein an additional side edge restricting plate extending rearwardly of the additional separating claw is annexed to the additional separating claw, and the carrier plate has a cut through which the additional separating claw and the additional side edge restricting plate can extend.

25. The electrostatic copying apparatus of claim 19 wherein the paper receiving receptacle has a paper carrier plate whose rear end portion is pivotably mounted, and a pivoting means for pivoting the carrier plate;

a delivery roller located above the carrier plate is provided in the copying paper cassette receiving section;

when the copying paper is returned to the paper receiving receptacle, the carrier plate is spaced away from the delivery roller; and when the copying paper is delivered from the paper receiving receptacle to the paper conveying passage, the carrier plate is pivoted by the pivoting means in a direction in which its front portion rises, whereby the copying paper on the carrier plate is pressed against the delivery roller and delivered by the rotation of the delivery roller.

26. The electrostatic copying apparatus of claim 25 wherein the pivoting means has a push-up means adapted to abut elastically against the lower surface of the carrier plate.

27. An electrostatic copying apparatus comprising:

a main housing;

an electrostatic photosensitive member disposed within the main housing and adapted to be moved through an endless path;

means defining a latent electrostatic image-forming zone, a developing zone and a transfer zone successively in the moving direction of the photosensitive member along the endless path;

means for forming a latent electrostatic image on the photosensitive member in the latent electrostatic image-forming zone;

developing means in the developing zone for developing the latent electrostatic image on the photosensitive member to a toner image;

copying paper feeding means;

copying paper receiving means;

means defining a copying paper conveying passage extending from the paper feeding means to the paper receiving means via the transfer zone;

copying paper conveying means for conveying a copying paper through the copying paper conveying passage;

transfer means for transferring the toner image on the photosensitive member to copying paper in the transfer zone;

fixing means for fixing the toner image on the copying paper, said fixing means being disposed at that position of the paper conveying passage which is downstream of the transfer zone;

copying paper swerving means disposed within the paper conveying passage and between the fixing means and the paper receiving means and adapted to be selectively held at a non-operating position at which the swerving means permits copying paper to be discharged into the paper receiving means through the paper conveying passage and an operating position at which the swerving means swerves the copying paper from the conveying passage;

a paper re-feeding means for feeding the received copying paper into the paper conveying passage at a position upstream of the transfer zone;

copying paper returning means for returning swerved copying paper to the paper re-feeding means while the front and back surfaces of the paper are reversed, said swerved copying paper having been swerved from the paper conveying passage by the paper swerving means held at the operation position; and reverse carrying means disposed rearwardly of the paper re-feeding means and adapted to carry the copying paper from the paper returning means into the paper re-feeding means while the trailing and leading ends of the copying paper are reversed.

28. The electrostatic copying apparatus of claim 27 wherein said apparatus further comprises a supporting frame mounted detachably on the main housing, the paper re-feeding means includes a paper receiving receptacle formed in the front portion of the supporting frame; and the reverse carrying means is formed in the rear portion of the supporting frame.

29. The electrostatic copying apparatus of claim 28 wherein:

said reverse carrying means includes a moving plate adapted to be selectively held at a receiving position at which it is spaced away from the paper receiving receptacle and a feed position adjacent the paper receiving receptacle, and a feed means for moving the copying paper on the moving plate forwardly; and when the moving plate is held at the receiving position, the copying paper from the paper returning means is conveyed onto the moving plate from ahead of the moving plate, thereafter the moving plate is held at the moving position, and by the action of the feed means, the copying paper on the moving plate is moved forwardly and carried into the paper receiving receptacle.

30. The electrostatic copying apparatus of claim 29 wherein the receiving position of the moving plate is rearwardly and downwardly of the feed position.

31. The electrostatic copying apparatus of claim 30 wherein the feed means has a feed plate adapted to be moved in the front-rear direction on the moving plate.

32. An electrostatic copying apparatus comprising:

a main housing;

an electrostatic photosensitive member disposed within the main housing and adapted to be moved through an endless path;

means defining a latent electrostatic image-forming zone, a developing zone and a transfer zone successively in the moving direction of the photosensitive member along the endless path;

means for forming a latent electrostatic image on the photosensitive member in the latent electrostatic image-forming zone;

developing means in the developing zone for developing the latent electrostatic image on the photosensitive member to a toner image;

copying paper feeding means;

copying paper receiving means;

means defining a copying paper conveying passage extending from the paper feeding means to the paper receiving means via the transfer zone;

copying paper conveying means for conveying a copying paper through the copying paper conveying passage;

transfer means for transferring the toner image on the photosensitive member to copying paper in the transfer zone;

fixing means for fixing the toner image on the copying paper, said fixing means being disposed at that position of the paper conveying passage which is downstream of the transfer zone;

copying paper swerving means disposed within the paper conveying passage and between the fixing means and the paper receiving means and adapted to be selectively held at a non-operating position at which the swerving means permits copying paper to be discharged into the paper receiving means through the paper conveying passage and an operating position at which the swerving means swerves the copying paper from the conveying passage;

a paper re-feeding means for feeding the received copying paper into the paper conveying passage at a position upstream of the transfer zone;

copying paper returning means for returning swerved copying paper to the paper re-feeding means while the front and back surfaces of the paper are reversed, said swerved copying paper having been swerved from the paper conveying passage by the paper swerving means held at the operation position; and a subsidiary housing separably combined with the main housing, at least a part of the paper returning means being mounted within the subsidiary housing.

33. The electrostatic copying apparatus of claim 32 wherein the subsidiary housing is located beneath the main housing.

34. The electrostatic copying apparatus of claim 33 wherein the paper swerving means is disposed within the main housing, and the paper swerving means held at the operating position swerves the copying paper downwardly from the paper conveying passage to the copying paper returning means.

35. The electrostatic copying apparatus of claim 32 wherein the subsidiary housing has a first portion located beneath the main housing and a second portion positioned adjacent to one side surface of the main housing;

the paper receiving means is annexed to that side surface of the second portion of the subsidiary housing which is remote from said one side surface of the main housing, and the paper conveying passage extends from the inside of the main housing to the paper receiving means via the second portion of the subsidiary housing;

the paper swerving means is disposed within the second portion of the subsidiary housing;

at least a part of the paper returning means is mounted within the first portion of the subsidiary housing; and the paper swerving means held at the operating position swerves the copying paper downwardly from the paper conveying passage.

36. The electrostatic copying apparatus of claim 32 wherein said apparatus further comprises a supporting frame detachably mounted on the main housing, and the paper re-feeding means includes a paper receiving receptacle formed in the supporting frame.

37. The electrostatic copying apparatus of claim 36 wherein a copying paper cassette receiving section is formed in the main housing, and a copying paper cassette and the supporting frame are selectively mounted on the paper cassette receiving section.

38. The electrostatic copying apparatus of claim 36 wherein a reverse carrying means disposed rearwardly of the paper receiving receptacle and adapted to carry the copying paper from the paper returning means into the paper receiving receptacle while the leading and trailing ends of the paper are reversed.

39. The electrostatic copying apparatus of claim 36 wherein the upstream portion seen in the paper returning direction of the paper returning means is mounted within the subsidiary housing, and its downstream portion is mounted on the supporting frame.

40. The electrostatic copying apparatus of claim 39 wherein said apparatus further comprises an additional copying paper receiving receptacle capable of being detachably mounted on the subsidiary housing when the supporting frame has been detached from the main housing; and when the additional paper receiving receptacle is mounted on the subsidiary housing, the copying paper from the upstream portion of the paper returning means is carried into the additional paper receiving receptacle.

41. The electrostatic copying apparatus of claim 40 wherein the additional paper receiving receptacle can be mounted on the main housing instead of the supporting frame, and in this case, the copying paper in the additional paper receiving receptacle can be delivered to the paper conveying passage at a position upstream of the transfer zone.

* * * * *